US009297155B2

(12) United States Patent
Ralea

(10) Patent No.: US 9,297,155 B2
(45) Date of Patent: Mar. 29, 2016

(54) TOILET BRUSH AND CLEANING SYSTEM

(76) Inventor: Cristiana Maria Ralea, Bucharest (RO)

( * ) Notice: Subject to any disclaimer, the term of this patent is extended or adjusted under 35 U.S.C. 154(b) by 96 days.

(21) Appl. No.: 14/130,323

(22) PCT Filed: Jul. 13, 2012

(86) PCT No.: PCT/IB2012/053601

§ 371 (c)(1),
(2), (4) Date: Dec. 31, 2013

(87) PCT Pub. No.: WO2013/008212

PCT Pub. Date: Jan. 17, 2013

(65) Prior Publication Data

US 2014/0137357 A1 May 22, 2014

Related U.S. Application Data

(60) Provisional application No. 61/507,134, filed on Jul. 13, 2011.

(51) Int. Cl.

| | |
|---|---|
| ***E03D 9/00*** | (2006.01) |
| ***A46B 13/00*** | (2006.01) |
| ***E03D 9/06*** | (2006.01) |
| ***A46B 11/00*** | (2006.01) |
| ***A46B 13/02*** | (2006.01) |
| ***E03D 9/02*** | (2006.01) |

(52) U.S. Cl.

CPC ..... *E03D 9/002* (2013.01); *A46B 11/002* (2013.01); *A46B 13/02* (2013.01); *E03D 9/00* (2013.01); *E03D 9/02* (2013.01); *E03D 9/06* (2013.01); *A46B 2200/304* (2013.01)

(58) Field of Classification Search

CPC ..... A46B 2200/304; A47K 17/00
USPC ..... 15/21.1, 56, 246, 246.5; 4/222, 223, 4/661, 662

See application file for complete search history.

(56) References Cited

U.S. PATENT DOCUMENTS

| | | | | |
|---|---|---|---|---|
| 3,150,399 | A * | 9/1964 | Mann et al. | 15/246.5 |
| 4,353,144 | A * | 10/1982 | Mayberry | 15/246 |
| 6,772,450 | B1 | 8/2004 | Saylor et al. | |
| 8,011,051 | B1 * | 9/2011 | Ba-Akeel et al. | 15/56 |
| 2009/0044322 | A1 | 2/2009 | Nunez et al. | |

FOREIGN PATENT DOCUMENTS

| | | | |
|---|---|---|---|
| DE | 3932126 | * | 2/1991 |
| DE | 29621394 | U | 2/1997 |
| JP | 2002-129627 | * | 5/2002 |

* cited by examiner

*Primary Examiner* — Mark Spisich
(74) *Attorney, Agent, or Firm* — Mark M. Friedman

(57) ABSTRACT

A toilet cleaning system is disclosed, including (a) a brush adapted to clean an inner surface of a toilet bowl of a toilet; (b) a brush control mechanism adapted to control movement of the brush in the toilet; and (c) a support assembly adapted to operationally couple the brush control mechanism and the brush to the toilet.

18 Claims, 16 Drawing Sheets

TOILET BRUSH AND CLEANING SYSTEM

RELATED APPLICATION

This patent application claims priority from, and the benefit of, U.S. Provisional Patent Application No. 61/507,134, filed Jul. 13, 2011, which is incorporated in its entirety as if fully set forth herein.

FIELD AND BACKGROUND OF THE INVENTION

The present invention relates to a toilet cleaning system and, more particularly, to a toilet brush and cleaning system which is integrated into a conventional toilet.

The common method of cleaning toilets is to use a disinfectant/detergent which is manually applied and then, if necessary, scrub with a toilet brush populated with stiff bristles. Additionally or alternatively a slow release dispenser with solid (soluble) or liquid detergent can be attached to the toilet (usually with a securing arm over the rim of the toilet), so that detergent is dispensed each time the toilet is flushed. Another option is a dissolvable solid detergent which is inserted into the water tank and dissolves over time, filling each new tank of water with detergent.

All of the prior art solutions fail to adequately provide a system which provides both detergent as well as an active cleaning solution, to replace the manual act of scrubbing a toilet.

It would be highly advantageous to have an electronically or mechanically driven system which cleans and disinfects the internal surface of a toilet without the need for human contact with the cleaning accessories.

SUMMARY OF THE INVENTION

The current innovation discloses an electronically or mechanically driven system which cleans and disinfects a toilet without the need for human contact with the cleaning accessories. The innovation combines the disinfectant/detergent and cleaning apparatus into a single system.

According to the present invention there is provided a toilet cleaning system, including: (a) a brush adapted to clean an inner surface of a toilet bowl of a toilet; (b) a brush control mechanism adapted to control movement of the brush in the toilet; and (c) a support assembly adapted to operationally couple the brush control mechanism and the brush to the toilet.

According to further features in preferred embodiments of the invention described below the system further includes: (d) a movement actuation arrangement, operationally coupled on a first end to the support assembly and on a second end to the brush control mechanism, wherein the movement actuation arrangement is configured to effect a reversible downward movement of the brush control mechanism towards a floor of the toilet bowl.

According to still further features in the described preferred embodiments wherein the brush is a coiled brush including: (i) a flexible metallic core; (ii) a protective cover, covering the metallic core; and (ii) bristles, populating the protective cover, wherein the coiled brush is adapted to be installed in the toilet bowl such that torque of the coiled brush provides sufficient expansion force for the coiled brush, in a resting expanded state, to remain at an upper-most position beneath a lip of the toilet bowl of the toilet and in an active state, when the torque is increased, to rotate and descend down the inner surface from the upper-most position until the torque of the coiled brush is decreased.

According to still further features the brush control mechanism includes: (i) a dual-element construct, configured to convert linear motion into rotational motion, the dual-element construct including: (A) a linear element; and (B) a rotational element, wherein the rotational element, is operationally coupled to the coiled brush; and whereby linear movement of the rotational element along the linear element causes the rotational element to rotate, thereby effecting rotational movement of the coiled brush coupled thereto, thereby reversibly increasing the torque of the coiled brush, causing the coiled brush to rotate, contract and move linearly in the direction dictated by the rotational element.

According to still further features the brush control mechanism further includes: (ii) a slideable element coupled to the dual-element construct; and (iii) a guide shaft, housing the slideable element, wherein the slideable element is configured to move within the guide shaft during the linear movement of the rotational element, the rotational element being operationally coupled to the slideable element.

According to still further features the brush control mechanism further includes: (iv) a pad having the linear element of the dual element construct mounted thereon and further having the guide shaft mounted thereon.

According to still further features the pad is adapted to convolve about an axle positioned below the toilet lip and made of elastic plastic material allowing the pad to convolve and unfurl.

According to still further features the brush control mechanism further includes: (iv) a rod, operationally coupled to a first end of the coiled brush and further operationally coupled to the rotational element where the rod includes (A) an axle portion, fixedly disposed in the slideable element, and (B) a termination portion, fixedly disposed in the rotational element. And flexible metallic core is threaded through a hole in the termination portion of the rod within the rotational element and attached to a point on an internal edge of the rotational element, the edge being adjacent to the slideable element, so that during the rotation of the rotational element, the flexible metallic core is reversibly drawn out of the protective cover and reversibly wound around the rod. The brush control mechanism further includes: (v) a spindle, operationally coupled to a second end of the coiled brush, the spindle forming an axle for the rotational element such that when the rotational element rotates, the spindle reversibly increases the torque on the coiled brush.

According to still further features the support assembly includes a clip configured to latch onto a toilet bowl rim of the toilet and further includes a securing means, for securing the support assembly to the toilet bowl rim.

According to still further features the system further includes (d) a fluid tube, configured to electively hold and release fluid. Potentially the fluid tube includes at least one accordion pleat section, adapted to electively expand and contract. In some embodiments the fluid tube is configured to be positioned beneath a lip of a toilet. In some embodiments the fluid tube is operationally coupled to the brush. In some embodiments the system further includes (e) a detergent reservoir, the reservoir configured to receive a fluid, wherein the detergent reservoir is operationally coupled to the fluid tube, configured to supply the fluid tube with the fluid. Wherein the detergent reservoir is configured to receive a prepackaged detergent container and wherein the detergent reservoir includes a penetrating element which is adapted to penetrate an access port on the prepackaged detergent container, such that when the port is penetrated by the penetrating element, detergent stored in the prepackaged detergent container comes into fluid communication with the fluid tube. Preferably the detergent reservoir is operationally coupled to the support assembly.

According to still further features movement actuation arrangement is actuated manually or automatically by a motor.

According to still further features the movement actuation arrangement includes at least one cable. Preferably, the support assembly further includes at least one bobbin coupled to the at least one cable, the at least one bobbin configured to electively collect and release the at least one cable.

According to still further features the at least one cable includes two cables.

According to still further features the at least one bobbin includes a pair of bobbins in interlocking mechanical communication so that each of the pair of bobbins moves in counter-rotation to the other bobbin.

According to still further features the at least one bobbin is operationally coupled to a handle for manual actuation of the at least one cable.

According to still further features the at least one bobbin is operationally coupled to a motor for automatic actuation of the at least one cable.

According to still further features the brush control mechanism further includes: (iv) a cog assembly, disposed in the slideable element; (v) a brush-rail, associated with the brush; and (vi) rail teeth, mounted on the brush rail, wherein the cog assembly is adapted to be in interlocking mechanical communication the rail teeth of the brush rail and wherein the cog assembly includes: (A) an upper cog, configured to interlock with the rail teeth mounted on a first end of the brush rail; (B) a middle cog, configured to interlock with sprockets of the rotational element; and (C) a lower cog, configured to interlock with the rail teeth mounted on a second end of the brush rail, wherein the upper cog, the middle cog and the lower cog share a common axle such that rotation of one of the cogs effects rotation of other the cogs, and wherein when the rotational element rotates, the sprockets effect rotation of the middle cog, effecting rotation of the upper and lower cogs, thereby effecting a gathering movement of the brush rail from the first end and the second end into the slideable element and wherein the cog assembly further includes: (D) a reverse cog, configured to interlock with the lower cog and the rail teeth mounted on the second end of the brush rail, interposing between the lower cog and the rail teeth, such that the reverse cog, when rotated, effects the gathering movement of the second end of the brush-rail, when the rail teeth mounted on the second end and the rail teeth mounted on the first end both face a common direction.

According to still further features the coiled brush is wound around the brush rail.

According to still further features the movement actuation arrangement includes a ball screw assembly coupled to the at least one cable such that when the at least one cable is actuated the ball screw assembly reversibly extends, effecting the reversible downward movement of the brush control mechanism towards the floor of the toilet bowl.

According to still further features the wherein the ball screw assembly includes: (i) a bobbin-cog for electively collecting in and spooling out the at least one cable, the bobbin-cog having a lower edge populated with circumferential sprockets; (ii) a threaded shaft, having a hollow internal lumen; (iii) a central cog fixedly coupled to a top edge of the threaded shaft, the central cog being in mechanical communication with the circumferential sprockets of the bobbin-cog such that when the at least one cable is actuated, the bobbin-cog rotates effecting counter rotation of the central cog and the threaded shaft; (iv) a nut, threaded on the threaded shaft such that the rotation of the threaded shaft effects reversible downward movement of the nut; (v) an internally threaded cylinder, containing the nut and the threaded shaft; (vi) a plurality of nestled pistons, operationally coupled to the nut such that the reversible downward movement of the nut effects reversible telescopic extension of the plurality of nestled pistons; (vii) a rejection spring interposed between the nut and a lowest edge of the plurality of nestled pistons, the rejection spring adapted to provided a retraction force to the telescopically extended plurality of nestled springs and wherein the lowest edge is operationally coupled to the brush control mechanism; and (viii) a retraction cable operationally coupling the bobbin-cog to the lowest edge of the plurality of nestled pistons via the hollow lumen of the threaded shaft, such that counter rotation of the bobbin-cog collects the retraction cable about a lower portion of the bobbin-cog effecting retraction of the telescopically extended plurality of nestled springs.

According to still further features the brush is a tube brush including: (i) a tubular body; (ii) a tube rail, mounted on the tubular body; (iii) rail teeth, mounted on the tube rail; and (iv) bristles populating the tubular body. The brush further includes: (v) an accordion pleat section of the tubular body, the accordion pleat section adapted to electively expand and contract. The brush control mechanism includes: (i) a cog assembly including: (A) an upper cog, configured to interlock with the rail teeth mounted on a first end of the tube rail; (B) a lower cog, configured to interlock with the rail teeth mounted on a second end of the tube-rail; and (C) an inner rod, forming a common axle for the upper cog and the lower cog, the inner rod operationally coupled to the threaded shaft such that rotation of the inner rod effects rotation of the upper and lower cogs, effecting a gathering movement of the tube rail. The cog assembly further includes: (D) a reverse cog, configured to interlock with the lower cog and the rail teeth mounted on the second end of the tube rail, interposing between the lower cog and the rail teeth, such that the reverse cog, when rotated, effects the gathering movement of the second end of the tube rail, when the rail teeth mounted on the second end and the rail teeth mounted on the first end both face a common direction.

According to still further features the movement actuation arrangement includes a plurality of nestled pistons.

According to still further features the plurality of nestled pistons is reversibly telescopically extended by a means selected from the group including: a hydraulic means and a pneumatic means.

According to still further features the toilet cleaning system is disposed within a water pipe connecting a water tank of the toilet to the toilet bowl of the toilet, such that the movement actuation arrangement is located within the toilet bowl.

According to still further features the support assembly includes a clip configured to latch onto the water tank of the toilet.

According to still further features the brush control mechanism further includes: (iv) a rejection spring, interposed between the slideable element and a bottom edge of the guide shaft, wherein the rejection spring is secured to the bottom edge of the guide shaft.

BRIEF DESCRIPTION OF THE DRAWINGS

Various embodiments are herein described, by way of example only, with reference to the accompanying drawings, wherein.

DESCRIPTION OF THE PREFERRED EMBODIMENTS

The principles and operation of a toilet cleaning system according to the present invention may be better understood with reference to the drawings and the accompanying description.

Figure 1:
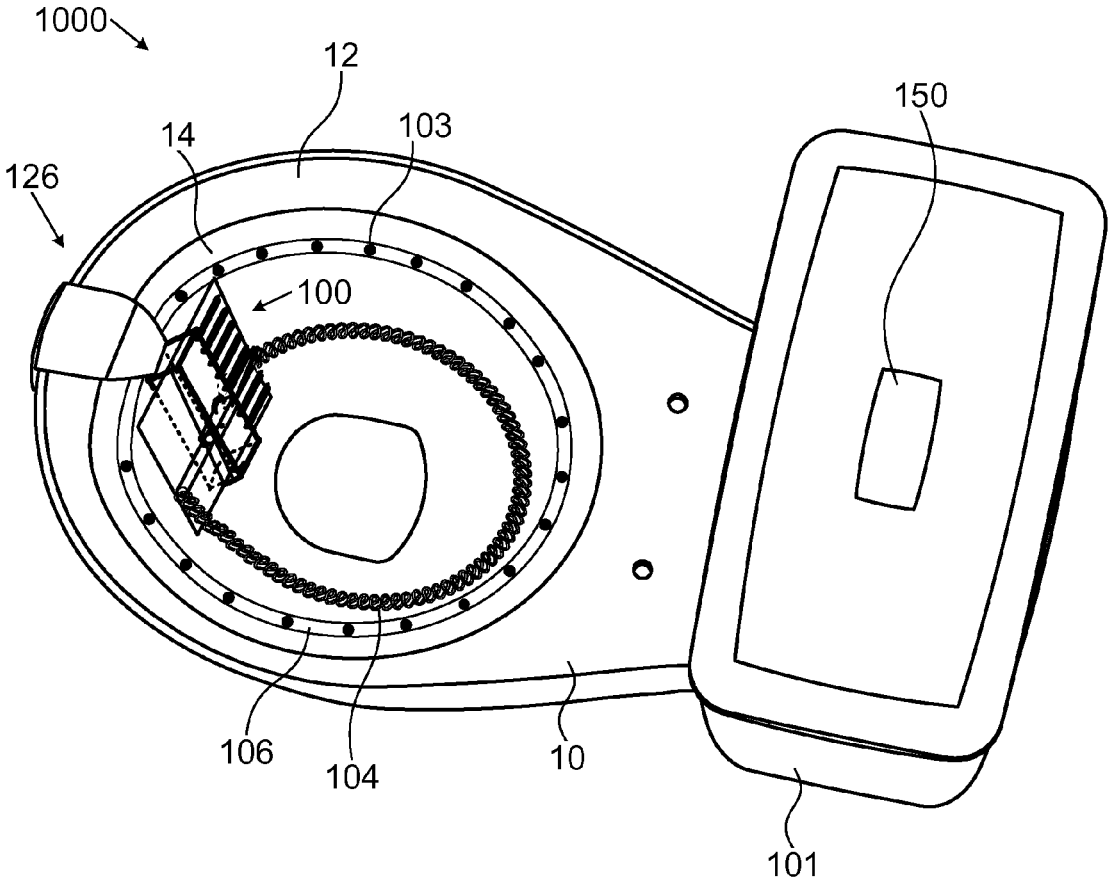
FIG. 1 is a partial view of the inventive system incorporated into a conventional toilet.

Referring now to the drawings, FIG. 1 is a overview of the first configuration of the inventive cleaning system unit 1000 incorporated into a conventional toilet 10.

The innovative toilet cleaning system 1000 includes three primary parts: the first part is an assembly 126 which supports the entire system; the second part is a control mechanism 100 which moves the brush up and down to clean the inside of the toilet bowl; and the third part is the cleaning brush 104 which cleans the inside of the toilet bowl.

Figure 1A:
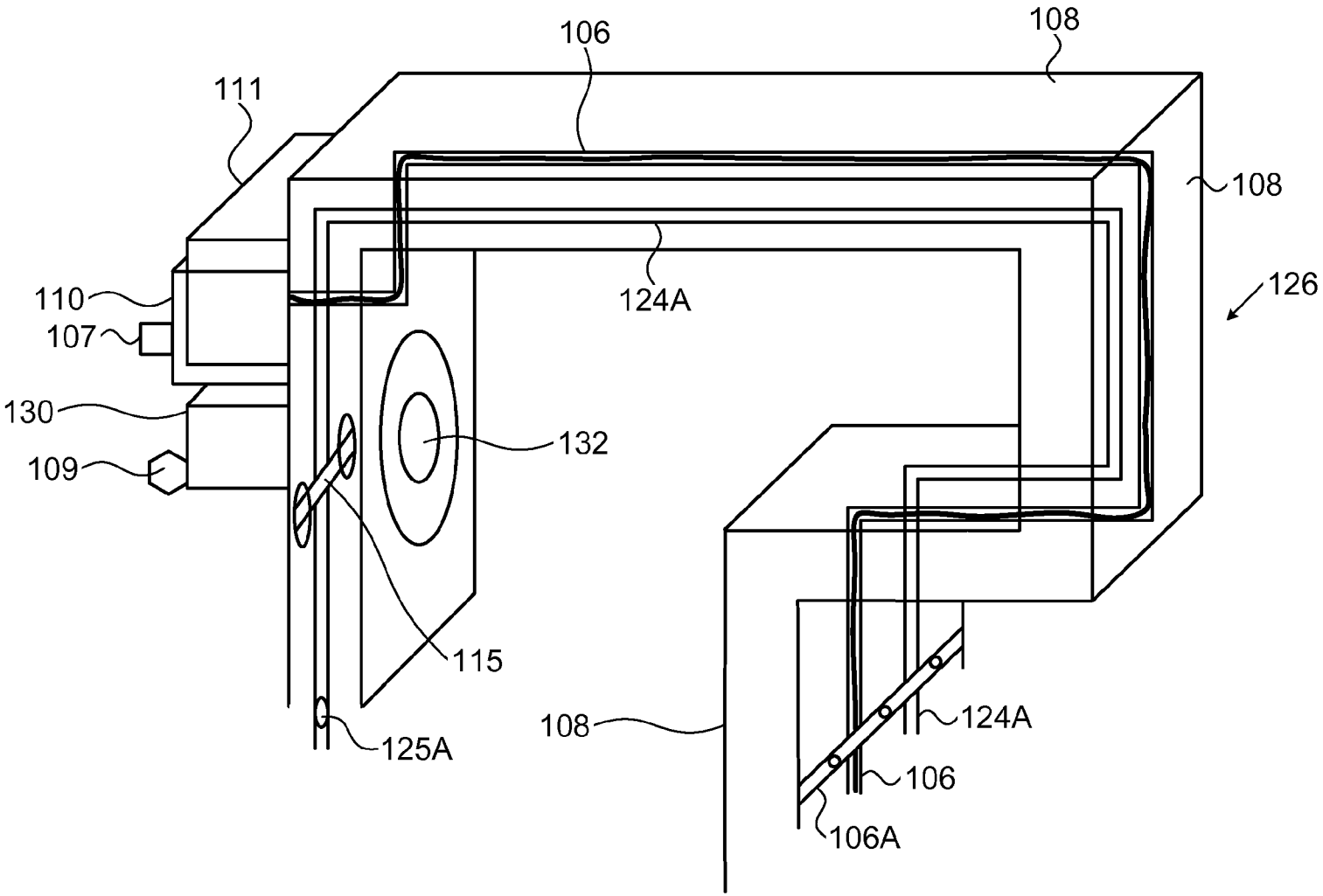
FIG. 1A is a schematic view of assembly 126 which is adapted to support inventive cleaning system 1000 over the rim of toilet 10.
Figure 1B:
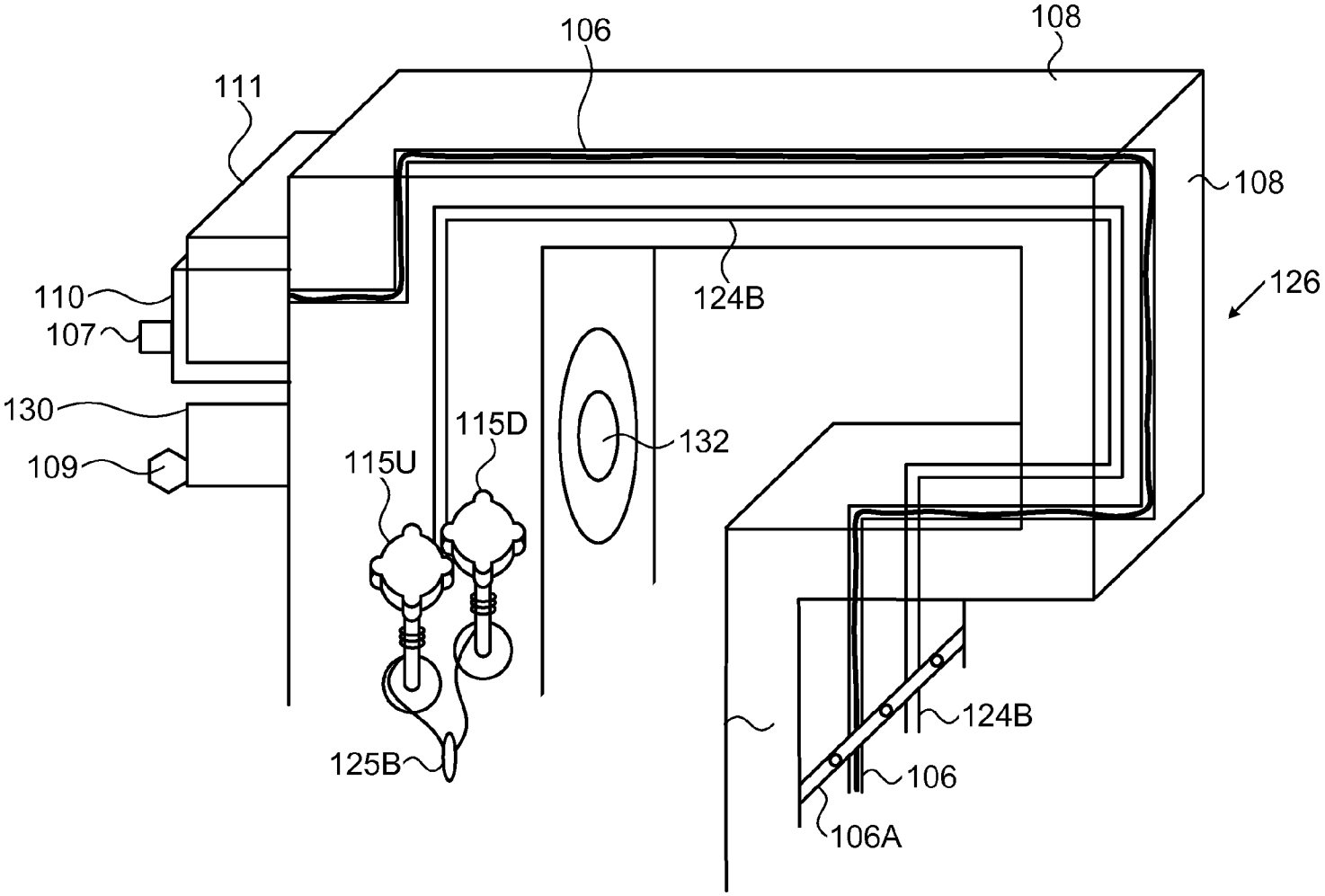
FIG. 1B is the second schematic view of assembly 126 which is adapted to support inventive cleaning system 1000 over the lip of toilet 10.

Two variations of assembly 126 are depicted in FIGS. 1A and 1B.

Figure 2:
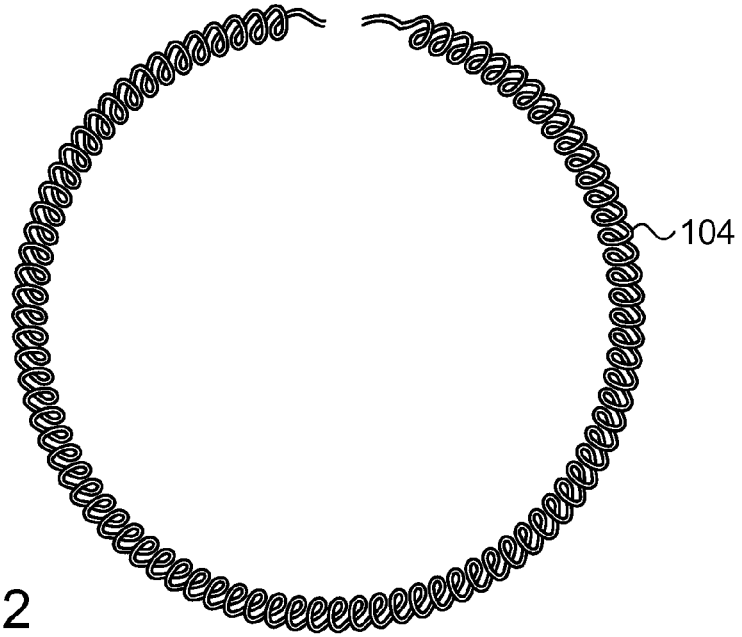
FIG. 2 is an inventive coiled brush 104 in an expanded state.
Figure 2A:
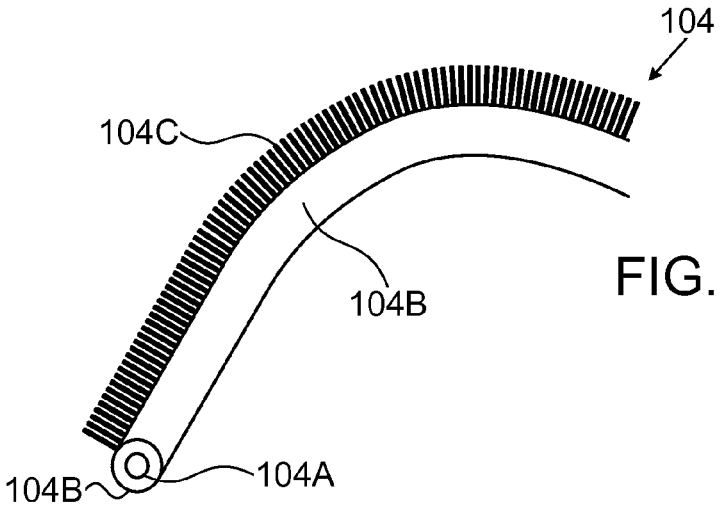
FIG. 2A is a segment of coiled brush 104 of the inventive system.
Figure 2B:
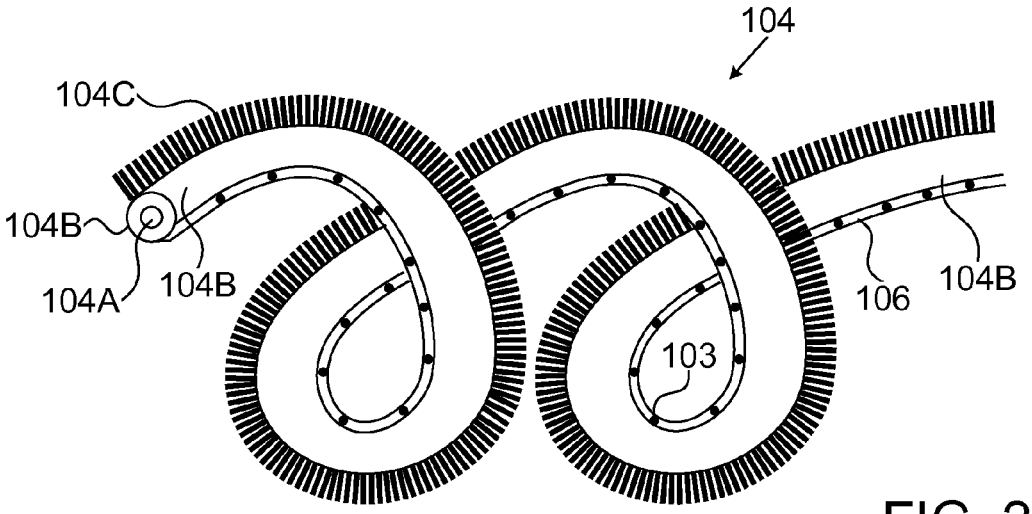
FIG. 2B is a segment of coiled brush 104 of the inventive system with tube having non-drip perforations.

Two variations of coiled brush 104 are depicted in FIGS. 2A and 2B.

Figure 4:
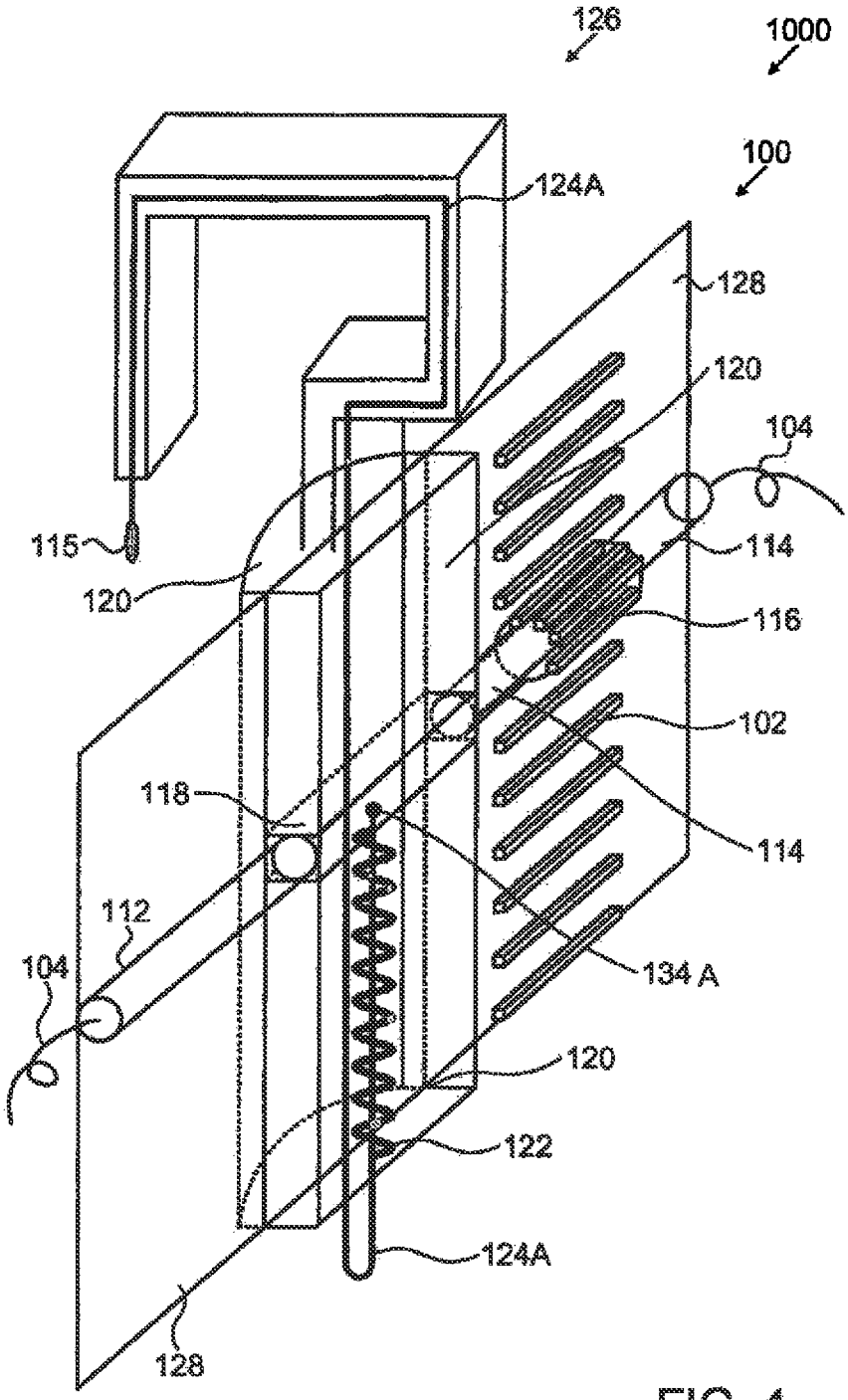
FIG. 4 is an isometric view of a first configuration of the movement control mechanism 100 of the inventive cleaning system 1000.
Figure 5:
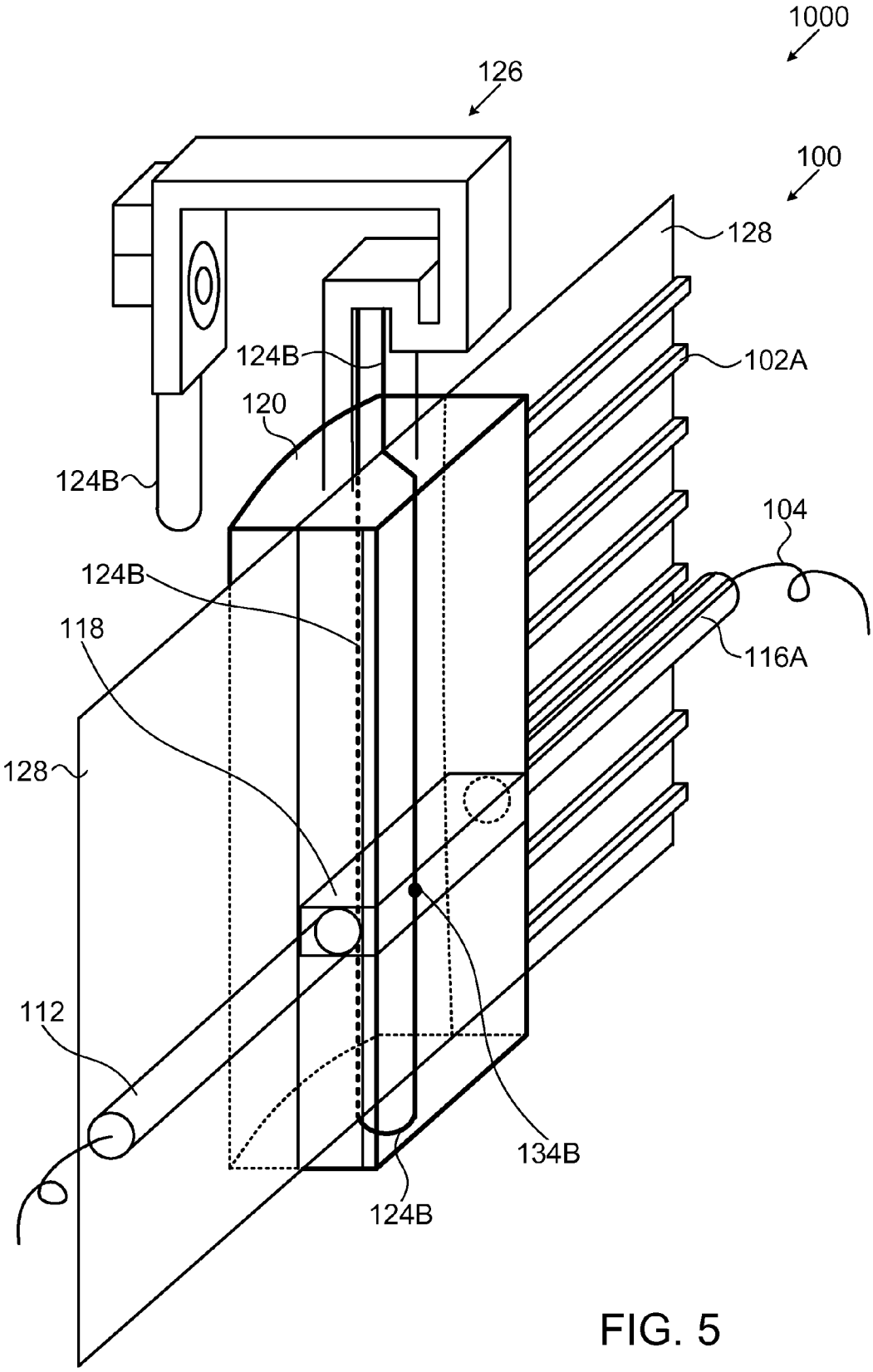
FIG. 5 is an isometric view of an illustrative depiction of a second configuration of the movement control mechanism of the inventive system.
Figure 6:
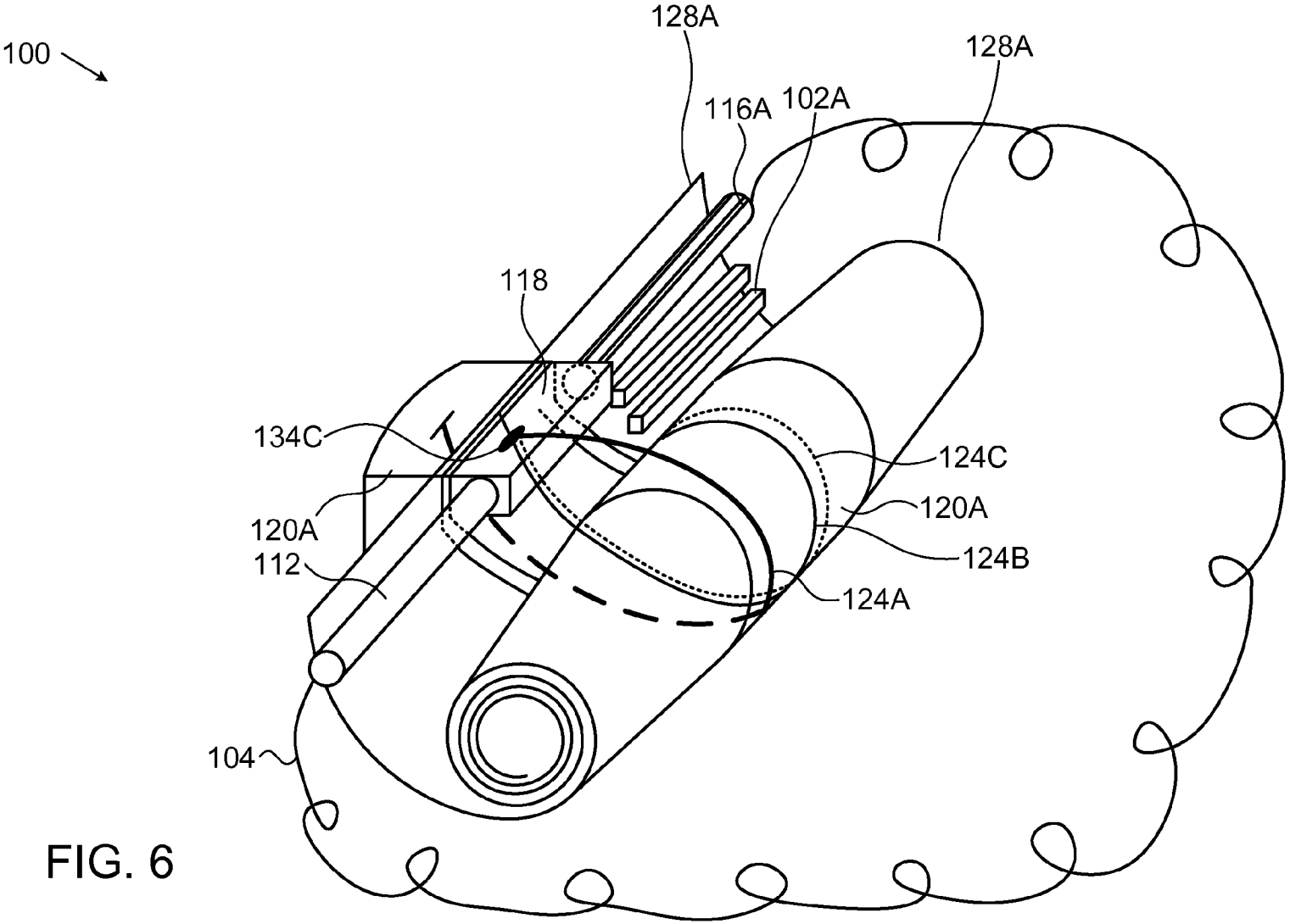
FIG. 6 is an isometric view of an illustrative depiction of a third configuration of the movement control mechanism of the inventive system where Pad 128A is in a convolved state.

Three variations of movement control mechanism 100 are shown in FIGS. 4-6.

Figure 7A:
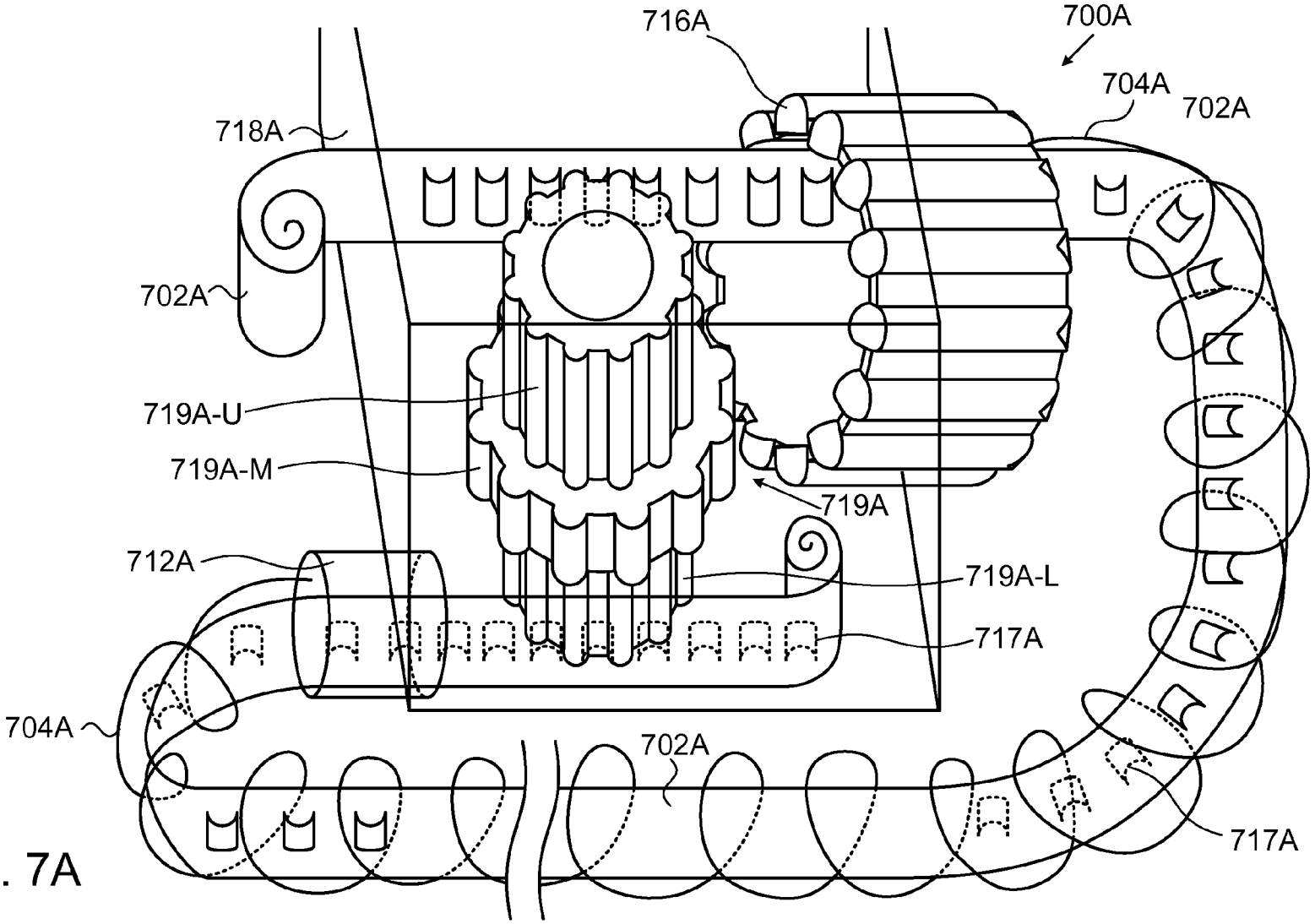
FIG. 7A is a schematic view of an optional configuration of the sliding element and brush which is compatible with each of the three configurations of the movement control mechanism.
Figure 7B:
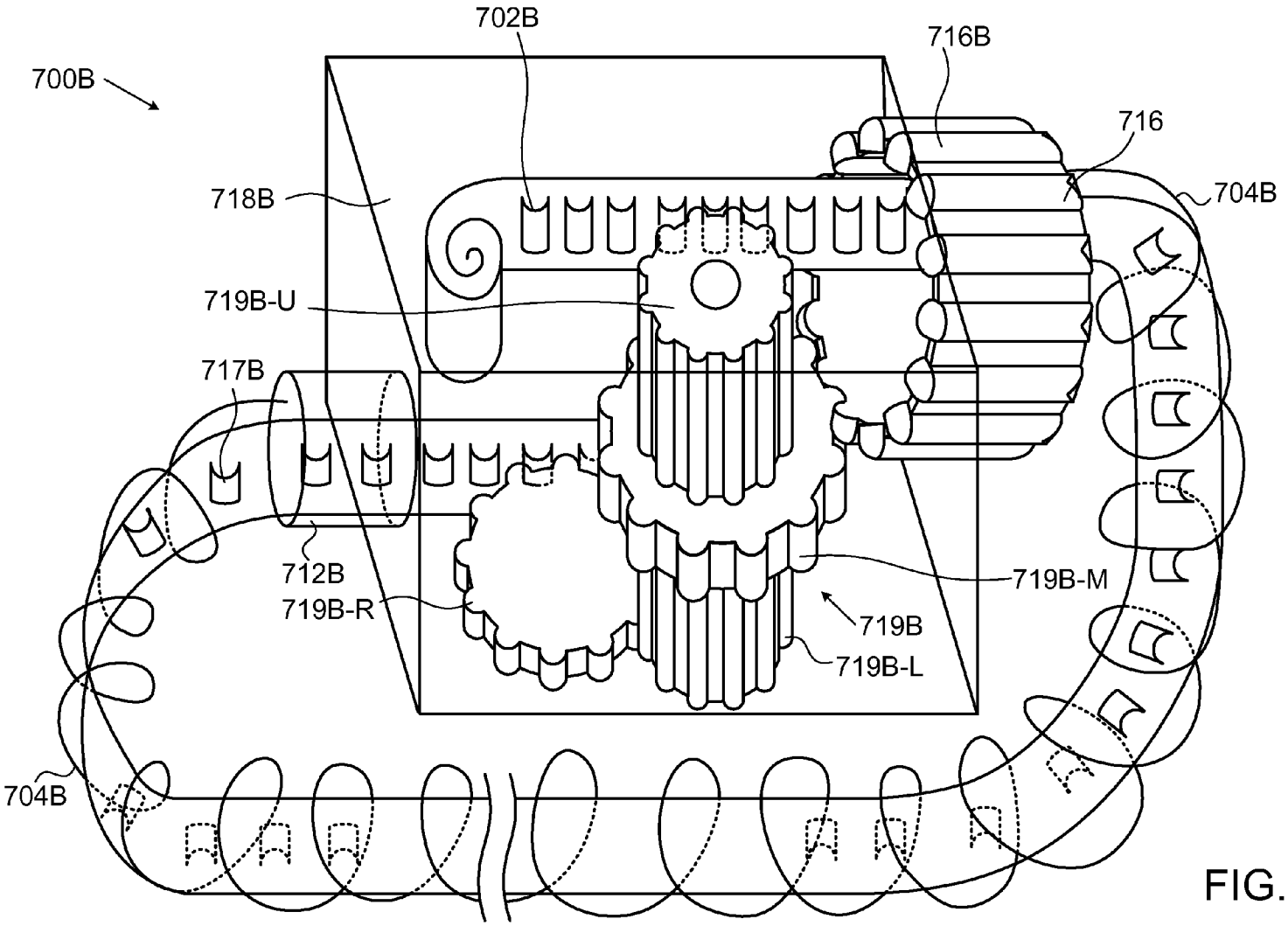
FIG. 7B is a schematic view of another optional configuration of the sliding element and brush which is compatible with each of the three configurations of the movement control mechanism.
Figure 7C:
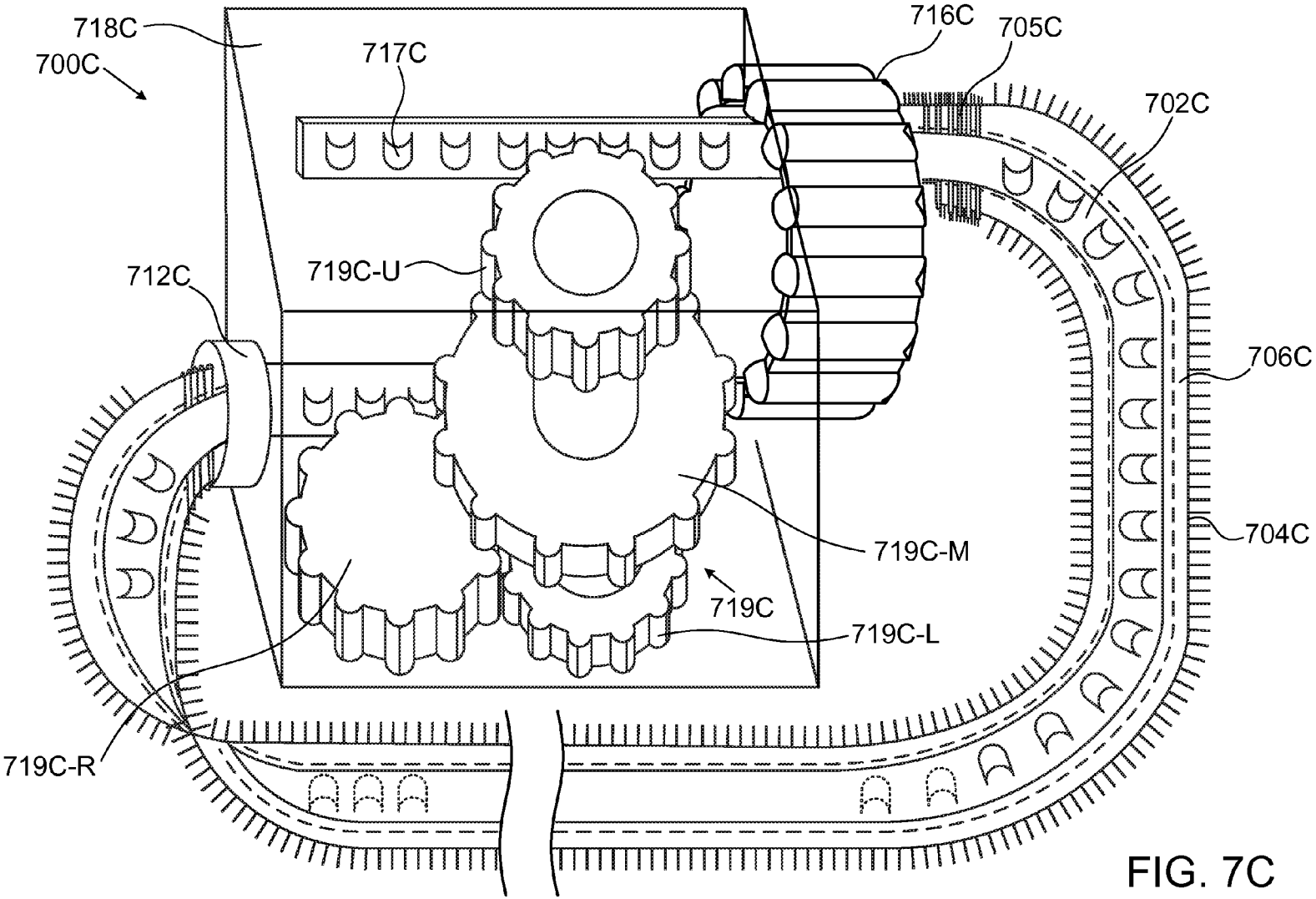
FIG. 7C is a schematic view of a further optional configuration of the sliding element and brush which is compatible with each of the three configurations of the movement control mechanism.

Control mechanism 100 includes a sliding element 118. Three variations of sliding element 118 are depicted in FIGS. 7A-7C.

The cleaning system 1000 can be attached to the toilet bowl in any effective manner and is preferably simple to attach and install. In the exemplary embodiment of the system depicted in FIG. 1, the innovative cleaning system 1000 is attached to the toilet bowl by means of sturdy yet flexible attaching arm or clip 108 which is fixed over the rim 12 of the toilet bowl (under the toilet seat) and preferably secured in place with a securing means such as a suction cup (or a similar mechanism such as a screw vice) 132. Clip 108, suction cup 132 and various other components together form assembly 126 which is discussed in greater detail with reference to FIGS. 1A-1B. It is clear, though, that any attachment means that would be obvious to one skilled in the art is included in the scope of the invention. Movement control unit 100 controls the movement of cleaning brush 104. The control unit moves the coiled brush down and up the inside of toilet bowl 10 and the bristles of the brush clean the internal surface. Brush 104 is coiled like a spring and expands and contracts as it moved up and down the inside of the toilet bowl 10. The tension on the coil (like a circular spring) continually tries to expand which creates friction between the coil brush and toilet wall. This friction helps the brush to clean the toilet wall as well as helping maintain contact with the toilet wall.

Each element of the system will be discussed in detail. Assembly 126 will be discussed in detail with reference to FIGS. 1A and 1B.

FIG. 1A is a magnified side view of a cross-section of assembly 126, which can only be partially seen in FIG. 1.

Referring now to FIG. 1A, assembly 126 includes: a clip 108 which function is to hook system 1000 over a rim 12 of a toilet bowl and secure it in place with the help of suction cup (or screw vice mechanism etc.) 132. The clip may be plastic or made of some other flexible yet sturdy material, such as aluminum, or both. The cross section of assembly 126 reveals a tube 106 and a pulling arrangement/movement actuation arrangement 124A (generally a cable or string) which are both thread through the body of assembly 126 and encased therein. Suction cup 132 secures the assembly to the outside of toilet bowl 10. On the external side of the toilet (depicted on the left of the Figure) there is depicted a reservoir 110 for holding liquid detergent which can also be a holder for a prepackaged container of liquid detergent. An exemplary prepackaged detergent container 111 is depicted in the Figure.

A button 107 can be depressed to mechanically/electrically release or squirt liquid from reservoir 110 and container 111 through tube 106 and out via non-drip perforations 103 formed in the tube and positioned strategically to expel detergent onto the inner wall of the toilet bowl. Pulling arrangement/movement actuation arrangement 124A is coupled to control unit 100 so that when manipulated, primarily effects a descent of the control unit 100 and brush 104. Generally, pulling arrangement 124A terminates in a handle 125A which can be pulled in order to manually manipulate pulling arrangement 124A.

Optionally, the assembly can include a motor or other electrical assembly 130 for controlling pulling arrangement 124A automatically in addition to or instead of manually. Motor 130 is actuated using control 109. Optionally, various buttons, levers, switches or other types of controls can be included in control 109. Functional buttons such as a Pause button, an Up/Down button, a Left/Right control and/or a Vibrate control (not shown) can be included in control 109 and employed for electively controlling the cleaning system. The ability to pause, move left or right and vibrate can help to clean a particular area in a more efficient way. Alternatively or additionally, control 109 can, for example, be a circular control similar to a round volume control which is rotated less than a quarter rotation left in order to reduce the volume and less than a quarter revolution right to increase the volume, and where a return spring returns the dial/control to the midpoint. Further alternatively control 109 can be a circular control similar to an egg-timer where the user rotates the dial to a certain point and the dial slowly returns to the zero point or upmost position (making a ticking noise). In a likewise fashion, turning the dial draws the cleaning apparatus down the toilet bowl and the mechanism slowly return to the zero point, retracting the cleaning system back up the toilet bowl.

Exemplarily, assembly 126 further includes a bobbin 115 for collecting/expanding/controlling pulling arrangement 124A when manipulated either manually or electronically. In order to facilitate manual manipulation, cable 124A terminates in a bead-shaped handle 125A which can be pulled in order to manually control the pulling arrangement. Additionally, in some embodiments, the reverse movement is also facilitated by pulling arrangement 124A attached to bobbin 115. Bobbin 115 is best suited to receive a cable with a single thread (i.e. not looped), such as the cable used in FIG. 4. Assembly 126 is connected to pad 128 near a lip 14 of the toilet bowl. Pad 128 is discussed in fuller detail with regards, at least, to FIG. 4.

A second variation of assembly 126 is depicted in FIG. 1B. The difference between the first variation of the assembly in FIG. 1A and the second variation depicted in FIG. 1B is that whereas in the first variation only a single bobbin 115 collects and releases cable 124A—in the second arrangement, there are provided two interlocking bobbins 115U and 115D. This arrangement is best suited to control the movement of a cable arrangement 124B which forms one long loop so that the two ends of the cable each collect around a separate bobbin. The bobbins are arranged such that when the cable 124B raises the movement control unit 100, then one end of the cable collects on bobbin 115U (Up) and is released from bobbin 115D (Down) and when the direction is reversed, bobbin 115U releases the end of the cable and bobbin 115D collects the other end of the cable. In one embodiment (shown in FIG. 1B) the cable forms a single continuous loop, while in another possible embodiment (not shown) the ends of the cable may terminate on each of the bobbins respectively and not connect together (the various configurations of the pulling arrangements/movement actuation arrangements and how they are coupled to the movement control unit 100 will be made clear in the discussion regarding FIGS. 4-6). The latter configuration (cable terminating on bobbins) is best suited for automatic actuation, whereas the former embodiment (continuous loop) can either be automatically or manually manipulated. In order to effect manual manipulation, the ends of cable 124B loop below the bobbins 115U/D (this is, of course, on the outside of toilet bowl) looping through a handle 125B not unlike the handle of a vertical window blinds (i.e. the weighted handle which moves the blinds back and forth along the rail). The cable can be pulled on each side of the handle resulting in either pulling the control unit up or down. There are different ways to collect/expand a pulling arrangement/movement actuation arrangement, such as one similar to an arrangement used for window blinds/shades. Although a somewhat detailed description of the pulling arrangement has been given, it is made clear that any modification or variation that would be obvious to one skilled in the art is included in the scope of the invention.

With reference now to FIGS. 1, 1A and 1B, there is provided a tube 106 which is adapted to convey disinfectant/detergent liquid for cleaning the toilet bowl. The tube is preferably positioned under the inner lip of the toilet bowl or thereabouts, and fitted along the circumference of the bowl. Preferably, several non-drip perforations 103 (shown in FIG. 1) in the tube allow disinfectant to be squeezed/forced/squirted out of the tube onto the walls of the toilet bowl, but prevent the detergent from dripping, when not applied. It would be clear to one skilled in the art to modify tube 106 in various ways to improve and/or reduce costs and/or become more efficient or functional. All such modifications are included in the scope of the invention.

Optionally, a 'squirting port' 106A (see FIG. 1A/B) may be formed in the section of assembly 126 which extends into the toilet bowl. The 'squirting port' may be adapted to spray detergent directly into the toilet bowl and/or against the facing toilet bowl wall and/or in a substantially semi-circular spread where the detergent is intended to reach as large a percentage of the surface of the toilet bowl wall as feasible.

In one preferred embodiment, the disinfectant liquid is stored in a reservoir 110. The reservoir is connected to tube 106 via a pipe or tubing shown in FIGS. 1A-1B. Alternatively and/or additionally, reservoir 110 can function as a holder for a prepackaged container of detergent. The prepackaged container is envisioned as having port through which the detergent flows out of the container. The port is initially sealed but configured to be easily perforated or penetrated by an element designed to perform this function. Preferably the perforating element is built into the holder and configured to allow detergent to flow out of the container and into tube 106 (e.g. similar to how a vacuum vial is used to draw blood by attaching the permeable top to the port inserted in the patients arm, where the port is similar to the perforating element of the immediate invention). When the container is empty it can be replaced with a new container which can be installed in the aforementioned manner. Reservoir 110 may be used interchangeably as a reservoir or a holder without any change to the structure itself.

In FIGS. 1, 1A/B, reservoir 110 is depicted attached to clip 108 on the outside of the toilet bowl and used to function as a holder for a prepackaged detergent container 111. Exemplarily, the prepackaged container is formed from a flexible material (e.g. plastic, aluminum etc.) so that when pressure is exerted directly on the container, detergent flows out of the container, through tube 106 and is expelled into the toilet bowl through the non-drip perforations. The currently depicted location is not practical for use as a reservoir for free flowing detergent. It is to be understood that the currently depicted position of reservoir 110 is merely exemplary and that reservoir may be located in any reasonable and functional position (i.e. not as part of assembly 126). For example, reservoir 110 may be located on top of a water tank 101 near to a flushing handle 150. Such positioning allows for easy refilling of the reservoir or replacement of spent detergent containers. Furthermore, the detergent may be expelled via other methods besides direct pressure, such as a lever or button 107 (FIG. 1A) which is configured to expel a predetermined amount of disinfectant into the toilet bowl, via tube 106. An alternative position (other than as depicted in FIGS. 1A/B) for such a lever or button is close to flushing handle 150 that flushes the toilet, although any reasonable position for the lever or button etc. is considered to be included in the scope of the invention. Of course, disinfectant can be released at any time, such as: prior to flushing, during cleaning, after flushing etc.

In either of the aforementioned embodiments, a solid detergent holder may be added to the system (on the inside of the toilet bowl) so that even when the system is not used, the cascading water will dissolve some of the solid detergent and therefore include some detergent/freshener during the flushing process.

FIGS. 2, 2A and 28 depict preferred embodiments of coiled brush 104. The terms 'coil', 'coiled brush', 'coiled toilet brush', 'coiled element' and 'brush', 'cleaning brush' and the like are all used interchangeably herein. FIG. 2 depicts an inventive coiled brush 104 in an expanded state (bristles of the brush are not shown in the figure but are clearly shown in FIGS. 2A and 28). The coiled brush 104 is configured to clean the internal surface of a toilet bowl. FIG. 2A depicts a segment of coiled brush 104 of the inventive system, which preferably has a flexible metallic core 104A, preferably covered by a plastic coating 1048 with bristles 104C. The metallic core and plastic coating are most clearly visible at the cross-section shown in the Figure. The brush/coil 104 rests at the top of the toilet bowl (e.g. beneath the lip 14 of the toilet), in an expanded state (as shown in FIG. 2), when not in use. In some embodiments, when the toilet is flu shed, the coil moves (or is drawn) from the upper part of the toilet bowl to the lower part of the toilet bowl, rotating or revolving and contracting as it descends, and in doing so, cleans the wall of the toilet bowl 10. Movement of the coiled brush 104 may be effected by cascading water resulting from the toilet being flushed. Alternatively or additionally, the movement of the brush may be effected manually (i.e. not necessarily at the time when the toilet is flushed) by pulling arrangement/cable 124A, as will be discussed below. Optionally, the coiled brush can be further configured to be moved laterally, from side to side, while descending and/or ascending to further enhance the cleaning capabilities of the brush. Alternatively and/or further optionally, the brush may be configured to be biased to one side when torque is applied (e.g. the coil contracts in diameter while moving toward the left-hand side of the control mechanism 100 which is discussed in further detail below) and move towards the opposite side when the torque on the coil is relaxed and the coil expands. The brush/coil must contract (achieved by applying torque to the coiled brush) as the diameter of the circumference of the toilet bowl becomes smaller as the brush gets lower in the toilet bowl. The manner of applying torque to the coiled brush is discussed in further detail below. Additionally the apparatus may further include a mechanism for extending and collecting a brush that cleans the bottom of the toilet bowl 10 after control unit 100 has reached the bottom of rail 102.

An alternative configuration is shown in FIG. 2B. FIG. 2B depicts a segment of coiled brush 104 of the inventive system, which preferably has a flexible metallic core 104A, preferably covered by a plastic coating 104B with bristles 104C. In the configuration depicted in FIG. 2B, tube 106 is attached to coil/brush 104 on the side of the brush opposite or away from bristles 104C. The non-drip perforations 103 may be positioned optimally so that the expelled detergent will make contact with the toilet bowl wall (at least when the coiled brush 104 is in the expanded state). The alternative configuration depicted in FIG. 2B improves the design of the system, at least, by lessening the number of elements to be introduced into the toilet. In FIGS. 2A and 2B only one line of bristles is shown, although it is clear that there can be more lines of bristles, longer bristles, etc.

Figure 3:
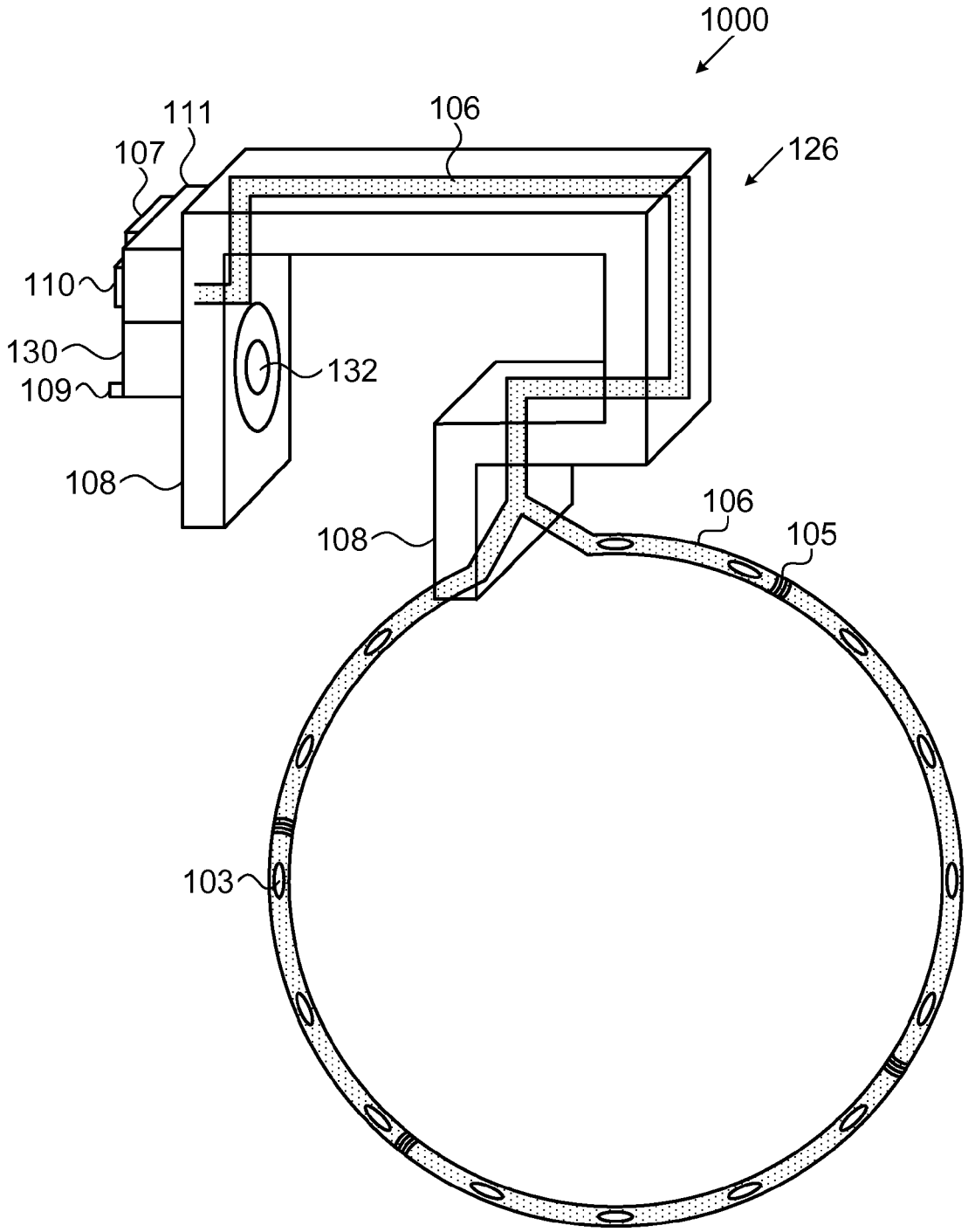
FIG. 3 is an isometric view of a configuration of system 1000 including an assembly 126 and a detergent tube 106 with non-drip perforations 103.

FIG. 3 is an isometric view of a configuration of system 1000 including only an assembly 126 and a detergent tube 106 with non-drip perforations 103. Tube 106 together with assembly 126 could function as a separate, independent unit as depicted in FIG. 3. FIG. 3 depicts a configuration including a clip 108 and a detergent tube 106 with non-drip perforations 103. In some embodiments, tube 106 also includes sections of accordion-pleat tubing 105 adapted to electively expand and contract (like in a flexible straw) for readily adapting tube 106 to various configurations of toilet bowls. In still further embodiments, the system additionally or alternatively includes a mechanism (disposed inside clip 108) for collecting and expanding tube 106 to the required dimensions. The tube extends from a reservoir 110 on the outside of clip 108 and runs through clip 108 into the toilet bowl. At the toilet bowl the tube forks off and completes a circle around the circumference of the bowl, positioned beneath or underneath the toilet bowl lip 14. Actuating button 107 is used for mechanically squirting detergent into the bowl. Optionally, the mechanism may be electronic (having a motor 130) and have a button 109 for actuating the squirting mechanism. In other embodiments, reservoir 110 and/or motor 130 and/or actuating button 107 and/or control 109 are positioned in any convenient location, such as, for example, near flushing handle 150.

Generally FIGS. 4-6 depict three configurations of movement control unit 100. Where possible, the same elements have been given the same reference numbers. Alternative elements usually have the same reference number with the addition of a letter (e.g. A, B, C . . . ). When various alternatives exist but only the numeral is referenced, the reference refers generally to the basic element, or where applicable, to all the variations of the same element. This rule is generally followed throughout the disclosure.

FIG. 4 is a schematic diagram of a first configuration of control mechanism 100 of the inventive system 1000. Referring now to FIG. 4, a pad 128 is coupled to the base of assembly 126. A guide shaft 120, and rail/rack 102 are formed on (the terms 'rack' and 'rail' are used interchangeably herein), or coupled to, pad 128. Assembly 126 is connected to pad 128 near the toilet bowl lip 14. Brush 104 connects to a rod 112 on the left-hand side and to a spindle 114 on the right-hand side. Rod 112 and spindle 114 control the ascent and descent of brush 104. Spindle 114 is coupled to sliding element 118 but revolves freely about the connection. Rod 112 is fixedly coupled to slideable element 118 on one end and to brush 104 on the other end. A pinion or cog wheel 116 is aligned with a rack 102. Rack 102 and pinion 116 are exemplary embodiments of a duel element construct including a linear element (e.g. rack 102) and a rotational element (e.g. pinion/cog 116). Pinion 116 is a circular gear which engages the teeth of rack 102. Spindle 114 serves as an axle for pinion 116, running through the center of the gear. Spindle 114 revolves as pinion 116 moves along rack 102. Optionally, rod 112 runs through sliding element 118 which travels up and down a guide shaft 120, and is fixedly secured therein. The sliding element 118 can have applicable geometric shape. Here it is depicted as a rectangular bar. Rod 112, spindle 114, sliding element 118 and pinion/cog 116 all move substantially freely about pad 128.

The rotation of spindle 114 serves the dual purpose of effecting longitudinal movement of the coiled brush 104, while at the same time increasing the torque of coiled brush 104, which causes the coiled brush to contract in diameter (when descending the rail). Consequently, coiled brush 104 rotates and contracts, cleaning the toilet bowl internal wall in a rotational movement while moving towards the bottom of the toilet bowl.

Alternative configurations in place of the rack and pinion configuration are envisioned. One non-limiting example of such an alternative arrangement may include a chain and sprocket configuration. In some embodiments, the teeth of pinion 116 may end in blades (not shown) so that the cascading water (from the flushing toilet) rotates the pinion like a waterwheel. In cases where the power of the cascading water is not sufficient to adequately effect/actuate the movement of the inventive coiled toilet brush 104, or when supplemental power is needed, an additional pulling arrangement/movement actuation arrangement is envisioned.

The aforementioned envisioned pulling arrangement is exemplarily depicted in the Figure and includes an actuating cable 124A, connected to sliding element 118. Cable 124A is threaded through clip section of assembly 126 as described with regards to FIG. 1A. The cable runs from clip section of assembly 126 down the back side of pad 128 and under the bottom edge of pad 128, coming up the front side of the pad the connecting to element 118 at a fixed connection point 134A. That is to say that the cable runs down the guide shaft between the pad and the toilet wall, before coming up the front side of the pad and connecting to the element 118. When the pulling arrangement is actuated from assembly 126 (on the outside of the toilet bowl), then element 118 is drawn downwards through guide shaft 120 towards the bottom of the toilet bowl until it meets a rejection spring 122 interposed between element 118 and a bottom edge of guide shaft 120, and is secured to the bottom edge of the guide shaft. Rejection/return spring 122 sends the sliding element back up the toilet bowl. Alternatively, the cable can be activated electronically/automatically as mention in relation to FIG. 1A. Where the cable is actuated electronically/automatically, a motor 130 actuates the cable pulling the cable as necessary. Either way (manually or electronically), when pulled, cable 124A draws element 118 downwards, towards the bottom of the toilet bowl as mentioned. Other more preferable embodiments will be discussed below. The currently discussed embodiment is the most basic embodiment, where the cable can only be pulled in one direction and the return spring pushes the element back up to the toilet lip 14.

Additionally, in some embodiments, the motor may further cause the brush to move laterally in a side-to-side manner (e.g. approximately 2-3 cm in each direction) in order to clean the wall of the toilet bowl better. Alternatively or additionally, the motor may cause coiled brush 104 to vibrate, a feature which is designed to improve the cleaning potential of the system. In some embodiments of the invention which include an automatic actuator, a Stop or Pause button 109 (FIG. 1A) may be incorporated in the actuator so that a user can pause ascent or descent of the brush and apply lateral gyration in order to clean a particularly dirty area more thoroughly.

When pulled, cable 124A moves control mechanism 100 towards the bottom of the toilet bowl (pulling down sliding element 118 through guide-shaft 120 and hence causing rod 112 and spindle 114 to descend and pinion 116 to roll down rack 102). When the toilet brush reaches the bottom of the bowl, sliding element 118 depresses a rejection/return spring 122, which in turn pushes/repels sliding element 118 back upwards. Once downward pressure is no longer exerted on cable 124A, coiled brush 104 will expand causing the brush to rise back to the top of the toilet. Rejection spring 122 ensures that coiled brush 104 does not get stuck at the bottom of the toilet bowl.

In an alternative embodiment, cable 124A may made of a stiff yet flexible material, such as hard plastic compound or a metallic compound (e.g. a plumber's cable), where the cable is sufficiently sturdy not only to pull the rod down but also to push the cleaning apparatus back to the top of the cleaning bowl. In some embodiments, cable 124A may be threaded through piping (e.g. PVC piping-not shown) which is fixedly attached to part of the guide shaft, running down back side (getting in contact with the toilet wall) and bottom of the shaft and up the front side of the shaft. The piping reduces friction and hence ware of the cable and chaffing of bottom edge of pad 128. The cable can potentially be electively actuated in a manner that draws the cleaning arrangement down to the bottom of the toilet bowl or propels the cleaning arrangement back to the top of the toilet bowl. Alternative mechanisms for returning the coiled brush to the top of the toilet bowl will be clear to those skilled in the art. In all embodiments, an assembly 126 (fully described in FIG. 1A) supports the entire system, and is attached to the toilet 10 rim 12 by clip 108 or a similar attaching element.

FIG. 5 is an isometric view of an illustrative depiction of a second configuration of the movement control mechanism 100 of the inventive system 1000. Referring now to FIG. 5, the immediately depicted configuration is very similar to the configuration depicted in FIG. 4 except for three differences. The first difference pertains to the pinion, which now takes the form of an elongated cog wheel 116A. There no longer exists a spindle, but rather cog wheel 116A encompasses all of the functions of the spindle and pinion of the control unit depicted in FIG. 4. Corresponding to the length of the cog wheel 116A, an elongated rail or system of teeth 102A is employed in the immediate configuration and fulfils the same function as rail 102 of the configuration in FIG. 4. The third distinction is that a pulling arrangement 124B, in the immediate configuration, forms a complete loop. The proximal edge of the loop extends outside the toilet where is circumvents handle 125B previously described in relation to FIG. 1B. The distal edge of loop comes around the bottom of pad 128 as described in relation to the embodiment depicted in FIG. 4. Whereas in the configuration of FIG. 4 the cable terminated at point 134A—in sliding element 118, here in the immediate configuration, the cable is merely fixed at a point 134B but the cable itself completes the loop running up the face of guide shaft 120 and threading back through assembly 126 as previously described. It is to be understood that the current configuration could equally function with either of the configurations of assembly 126 depicted in FIGS. 1A-1B, but may be better suited to the configuration of FIG. 1B. In the exemplary depicted embodiment, Rod 112 does not go through sliding element 118. Rather it is fixedly coupled to sliding element 118. In other embodiments, pad 128 can be rolled up like a window shade (discussed below) or gathered in a pleated manner like a fabric venetian blind with the help of an extra pulling arrangement 124B together with extra bobbin.

Figure 5A:
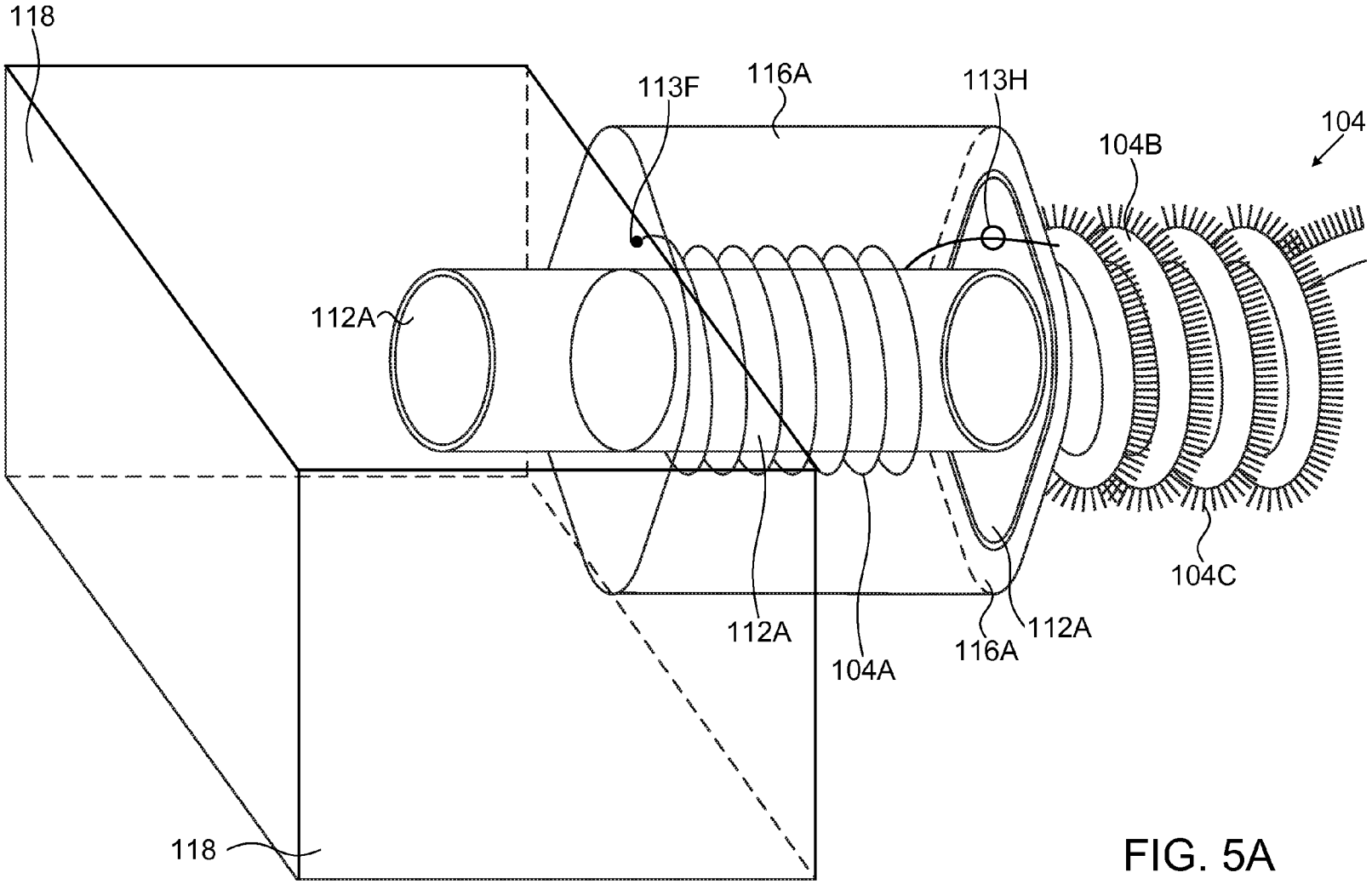
FIG. 5A is a magnified view of a section of the embodiment of control mechanism 100 depicted in FIG. 5.

FIG. 5A is a magnified view of a section of the embodiment of control mechanism 100 depicted in FIG. 5. FIG. 5A depicts an exemplary embodiment of the mechanism for increasing and decreasing torque of the brush 104. In FIG. 5A a section of brush 104 is depicted in a collected manner, substantially abutting elongated cog 116A. (It should be noted that the currently described mechanism can be easily modified to work equally with the configuration of the control unit depicted in FIG. 4 as well as other configurations mentioned elsewhere herein.) Cog 116A is hollow and contains there within the rightmost edge of rod 112 which runs from the left hand side of the control unit, through sliding element 118 and terminates in a substantially round head which has a larger diameter than the body of the rod. Whereas cog 116A rotates, rod 112 is fixed in place (i.e. secured within the body of sliding element 118). A hole 113H is disposed in rod head 112 through which metallic core 104A of the coil brush 104 is threaded, wound around the body of rod 112 and fixed at a point 113F. As cog 116A revolves, the metallic core 104A of brush 104 winds round rod 112, causing the brush to contract as the cog descends; or unwinds, causing the brush to expand as the cog rises. When metallic core 104A is collected around rod 112, plastic cover 104B (which is populated with brush bristles 104C) collects outside of cog 116A. As previously mentioned, the aforementioned mechanism is only one optional, exemplary, embodiment of how brush 104 expands and contracts. Also as previously mentioned, the immediate embodiment may be employed, with slight modification, to the embodiments depicted in FIGS. 4 and 6.

FIG. 6 is an isometric view of an illustrative depiction of a third configuration of the movement control mechanism of the inventive system where Pad 128A is in a convolved state.

Referring to FIG. 6 there is provided a configuration of the control unit which is substantially similar to the embodiment depicted in FIG. 5, with two differences. The first difference in the currently described configuration is that the unit includes a flexible, elastic plastic pad 128A. Pad 128A is similar to pad 128 of FIG. 5, differing only in that the currently depicted pad can be furled and unfurled like a window shade system with an additional pulling arrangement 124A which collects/extends and surrounds pad 128A. One end of the pulling arrangement 124A is fixed inside catch point 134C while the opposite end of the pulling arrangement 124A runs partially via guide shaft 120A into assembly 126 (via plastic clip 108) being controlled by the bobbin/s.

Pad 128A may be formed from plastic or metallic material or a composite of the two. It can be noticed in FIG. 6 that the shape of pad 128A is slightly convex so that another option for rolling up and unrolling pad 128A may be achieved by simply using the appropriate materials and construction of pad 128A so that the pad autonomously rolls back up (as the control mechanism rises) without using any extra pulling arrangements. A flexible rack 102A is integrated in Pad 128A as is a flexible guide shaft 120A. Rack 102A includes a plurality of equidistantly spaced bar-shaped protrusions or teeth which are adapted to interlock with an elongated sprocket/cog 116A which is likewise configured to receive the bar-like protrusions when rotating (in a similar fashion to that which has been described in relation to FIG. 5). Sliding element 118 is adapted to slide along guide shaft 120A in a similar fashion to that which has been described in relation to FIGS. 4-5.

The second distinction is that pad 128A is unfurled and furled with the help of an convolving cable 124C which runs in a loop, substantially parallel to cable 124B which is used to pull the control unit up or down (in a similar fashion to that which has been described in relation to FIG. 5). The loop has one end located outside of the toilet bowl and runs down the inside of the toilet bowl (i.e. between the pad and the toilet bowl wall via guide shaft 120A) under bottom edge of the pad and back up the other side out of the toilet bowl. Cable 124C is anchored at a catch point 134C located on (and in some embodiments even in) sliding element 118. When cable 124C is reeled in, then pad 128B is rolled up or convolved. When the cable is spooled out, then pad 128A is unrolled. Sliding element 118 always stays higher up than the convolved part of pad 128A, as can clearly be seen in FIG. 6. Catch point 134C anchors cables 124B and 124C in a manner that ensures that sliding element 118 and hence rod 112 and cog 116A always remain above the convolved section.

In some embodiments, an additional spindle forms the axle around which pad 128A is rolled up. The pad is rolled up near or under the toilet lip 14 (on the inside of the toilet bowl) with the control mechanism and brush attached to the lower edge of pad 128A. Here, pad 128A (and guide shaft and rail) need only be flexible but not elastic plastic.

In any of the aforementioned configurations, a solid detergent holder may be added to the system, (possibly located between Pad 128, plastic clip 108 and the toilet bowl wall), so that even when the system is not used, the cascading water will dissolve some of the solid detergent placed therein and therefore include some detergent/freshener.

FIGS. 7A, 7B and 7C are schematic views of three optional configurations of a rail and pinion assembly which are compatible with each of the three configurations of the movement/brush control mechanism described above.

Referring now to FIG. 7A, movement control mechanism 700A has the same general configuration as movement/brush control mechanism 100 (at least depicted in FIG. 5) except that coil 704A is wound around a circumferential brush rail 702A which is populated with teeth 717A. Rail 702A is operationally coupled to a set of cogwheels 719A. Cogwheels 719A are disposed within sliding element 718A (which has the same general structure as element 118 of FIGS. 4, 5 and 6). Assembly of cogwheels 719A includes an upper cogwheel 719A-U, a middle cogwheel 719A-M and a lower cogwheel 719A-L. Preferably, middle cogwheel 719A-M has a greater radius than upper- and lower-cogwheels 719A-U/L. (Potentially upper and lower cogwheels can be an upper and lower end of a single, longitudinally extended, cogwheel that is bisected by a larger cogwheel).

In general, teeth 717A of circumferential brush rail 702A interlock with the sprockets of upper cog 719A-U on the one side (right side) and with the sprockets of lower cog 719A-L on the other side (left side). Preferably, teeth 717A only populate a portion of rail 702A near sliding element 718A. Cog 716A (having the same general form and function as cog 116 of FIGS. 4-6) includes sprockets/teeth which jut out of the body of the cog (to the left) and into the space of sliding element 718A. The jutting sprockets/teeth of cog 716A interlock with the teeth of middle cogwheel 719A-M. The back-to-front rotational motion of cog 716A causes the left-to-right rotation of middle cogwheel 719A-M. The rotation of middle cogwheel 719A-M causes the rotation of the entire assembly 719A. Teeth of upper cogwheel 719A-U interlock with teeth 717A of rail 702A which runs through the hollow center of cog 716A and into sliding element 718A, potentially sliding along guiding grooves (not shown) inside 718A potentially exiting the left side of sliding element 718A and convolving in place.

At the same time, the teeth of lower cogwheel 719A-L interlock with teeth 717A of rail 702A which has twisted at some point so that teeth 717A are now facing in the direction of the toilet wall and fed through rod 712A and through sliding element 718A (potentially along guides which are not shown) and terminating in a convolved roll either in- or outside of sliding element 718A. The left-to-right rotation of lower cogwheel 719A-L and upper cogwheel 719A-U cause the rail 702A to 'gather' or collect, thereby shortening the overall circumference of the rail and subsequently the brush. This movement is caused as cog 716A descends down the toilet bowl wall towards the toilet bowl floor. This type of movement has been clearly detailed above in relation to the embodiments depicted in FIGS. 4-6. The reverse motion—i.e. ascending of cog 716A with a front-to-back rotation— causes the right-to-left rotation of cogwheel assembly 719A which 'feeds out' rail 702A from the upper and lower ends of sliding element 718A, thereby expanding the overall circumference of the rail and brush 704A. Coil brush 704A does not enter into the body of sliding element 718A rather the brush is to securing points on either side of sliding element 718A.

Referring now to FIG. 7B, control mechanism 700B works in a substantially similar manner to that described for control mechanism 700A. The main distinction between the current mechanism and the previously described mechanism is that here the rail makes a complete circuit around the circumference of the toilet bowl and reentering sliding element 718B while still facing outwards, i.e. towards the center of the toilet bowl. In this configuration the teeth are facing away from the toilet bowl wall and therefore there is less chance that the coil will get stuck in the teeth and jam the system. In order to gather/collect rail 702B on the lower, left side (not only on the upper right side) an additional reverse cogwheel 719B-R is added to assembly 719B. The teeth of reverse cogwheel 719B-R interlock with teeth 717B of rail 702B so that when lower cogwheel 719B-L rotates left-to-right, reverse cogwheel 719B-R rotates right-to left 'gathering' or collecting rail 702B into sliding element 718B (as described above). Coil brush 704B does not enter into the body of sliding element 718B rather the brush is to securing points on either side of sliding element 718B.

Referring now to FIG. 7C, control mechanism 700C works in a substantially similar manner to that described for control mechanisms 700A and 700B. The current embodiment differs with regards to brush 704C. Here, brush 704C is embodied as a tube covered with bristles and having a rail 702C, including teeth 717C running through the hollow center of the tube-brush. The brush may be embodied only as a half-tube or even a flat medium with bristles populating the surface of the tube that comes into contact with the toilet bowl wall. Teeth 717C of the rail, on the other hand, face the center of the toilet bowl. A further innovative distinction between the configuration of control mechanism 700C and the control mechanisms 700A/B is that the edges of the tube, half tube or flat medium are fluted such that the tube or medium can expand and contract like an accordion or like the flexible section of a flexible straw. Brush 704C has fluted edges 705C where the brush terminates at the sliding element 718C on both the right- and left-hand sides. The movement of cog 716C has been described both in relation to control mechanism 700A and control mechanism 700B. In the immediate configuration, when rail 702C gathers inside sliding element 718C (i.e. during downward motion), fluted edges 705C compress in the manner depicted in FIG. 7C (like closing an accordion). During a reverse movement (i.e. when ascending), as rail 702C draws outwards from sliding element 718C, and the fluted tube area 705C expands (like drawing an accordion wide open) to cover/surround the section of rail 702C which comes out of sliding element 718C. Tube 706C (like tube 106) including non-drip perforations for expelling detergent, can be incorporated in any manner that would be obvious to one skilled in the art.

While the two innovative aspects of the current embodiment have been incorporated into a control mechanism similar to control mechanism 700B is should be clear that innovative rail 702C and brush 704C can work equally as efficiently in control mechanism similar to control mechanism 700A as well.

Figure 8:
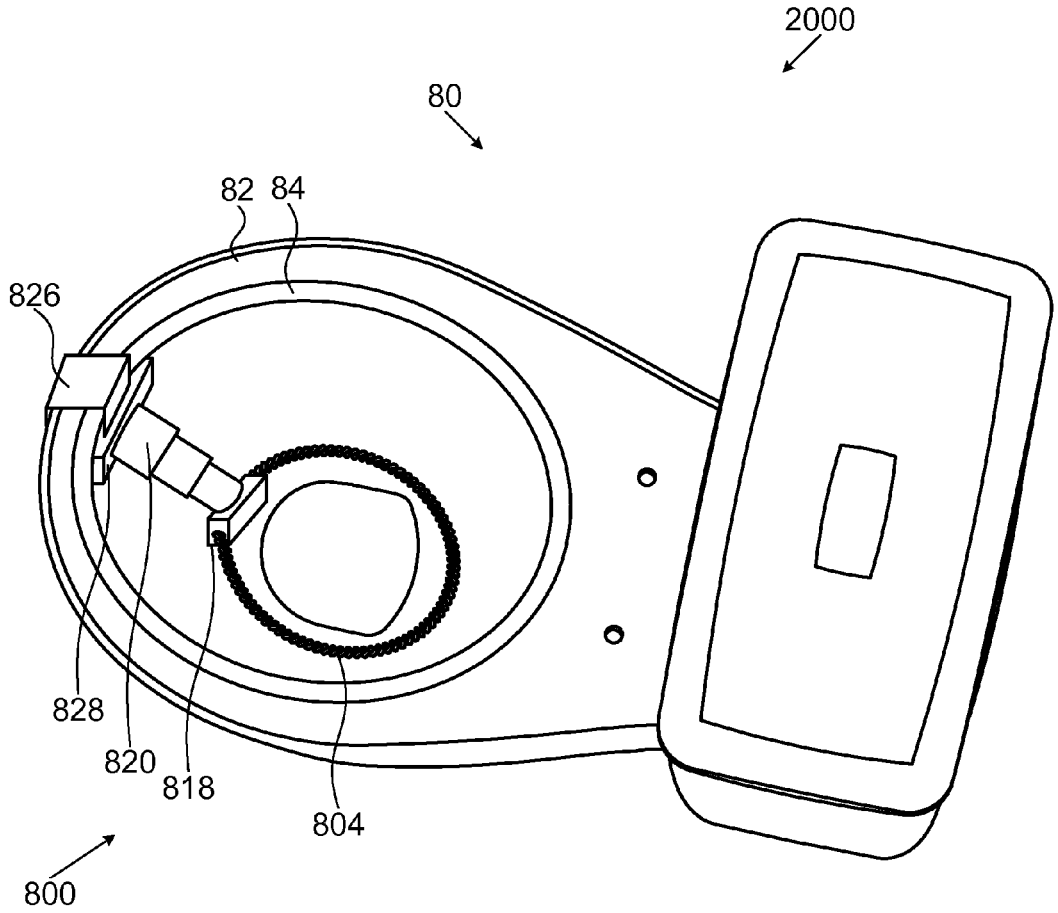
FIG. 8 is an overview of a second configuration of the inventive system (now referenced 2000) installed in a toilet 10.

FIG. 8 is an overview of a second configuration of the inventive system (now referenced 2000) installed in a toilet 80. Referring now to the Figure, a support assembly 826 attaches a control unit 800 to a rim 82 and lip 84 of toilet 80. Support assembly 826 is adapted to hold a reservoir of detergent as well as actuators and control mechanisms which control the movement of control unit 800. All applicable components described with regards to assembly 126 can be employed in the immediate support assembly. Furthermore, for convenience sake, automatic controls for both assembly 126 and support assembly 826 may be connected to a control panel (not shown) in a wired or even wireless manner so that control of cleaning apparatus can be managed from the control panel which is located in a convenient location, such as on the water tank or mounted on a nearby wall.

A platform 828 supports an extension/retraction assembly/movement actuation arrangement 820 which in turn supports an expansion/contraction assembly 818 which supports a brush 804 arrangement of the current invention. Each of the aforementioned components will be discussed in further detail with regards to FIGS. 8A-B which pertains to the cleaning assembly 2000.

Figure 8A:
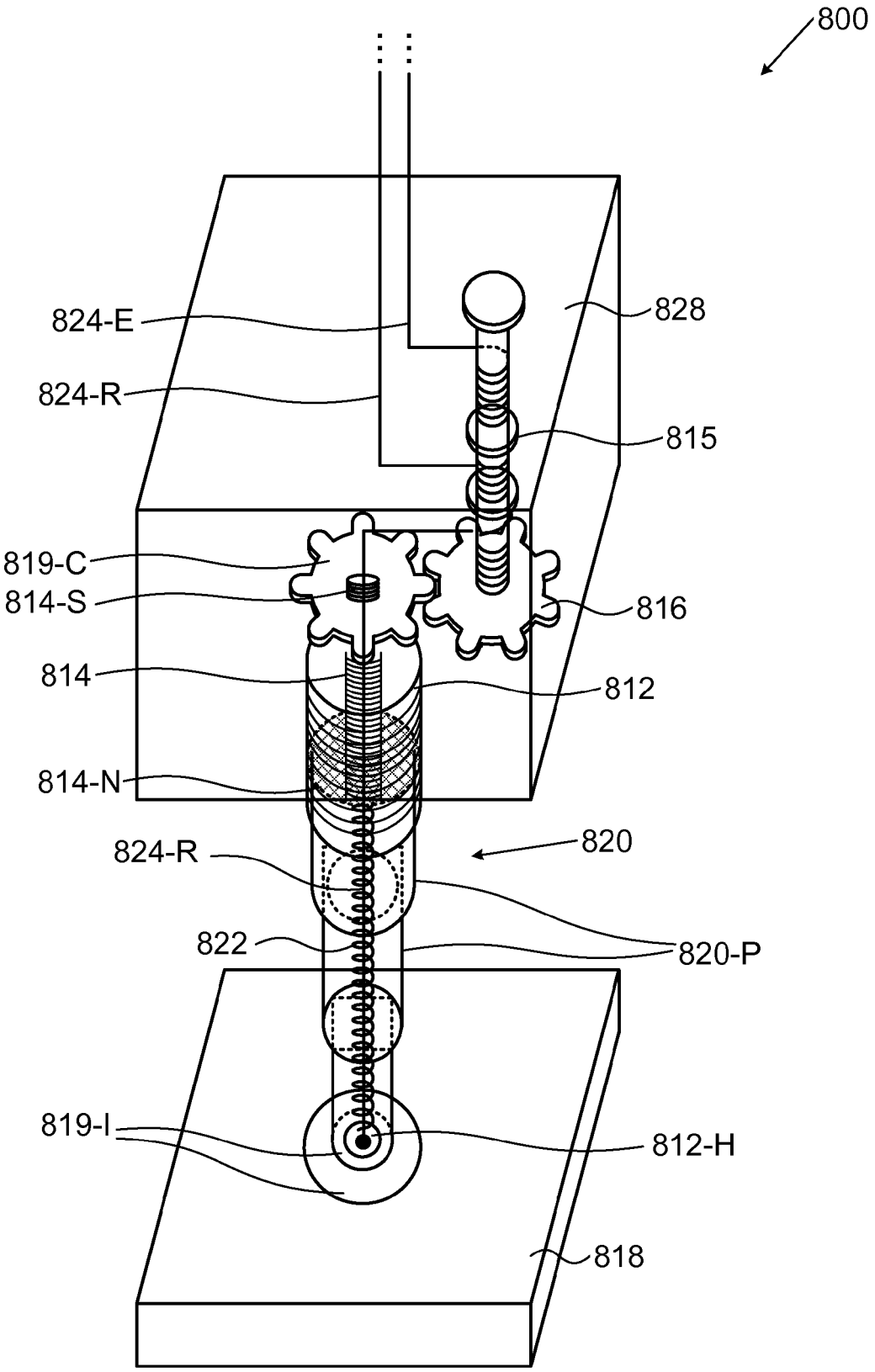
FIG. 8A is a detailed schematic view of a first configuration of the movement control mechanism of inventive system 2000.

FIG. 8A is a detailed schematic view of a first configuration of the brush control mechanism 800 of inventive system 2000. Referring now to FIG. 8A, platform 828 and extension/retraction assembly 820 are shown in greater detail. Two cables 824 control and effect extension and retraction of assembly 820. The two cables may be separate cables or the may be two ends of the same cable. In the immediate the cables are referred as if they are separate cables. An extension cable 824-E when pulled (manually or automatically) causes assembly 820 to extend. Extension cable 824-E is wound around a spring loaded bobbin 815 which terminates in a cog 816. When extension cable 824-E is pulled bobbin 815 rotates causing the rotation of an interlocked cogwheel 819-C. Cogwheel 819-C is coupled to a ball screw 814 which in includes a threaded shaft 814-S and a nut assembly 814-N. Ball screw 814 is contained within an internally threaded cylinder 812. Rotation of cogwheel 819-C causes nut assembly 814-N to descend pushing down nestled pistons 820-P to extend telescopically causing the extension/retraction assembly 820 to extend telescopically. The lowest piston terminates in an inner rod 819-I which is disposed within expansion/contraction assembly 818—the function of which will be detailed presently, with reference to FIG. 8B. To summarize, the rotation of cogwheel 819-C causes both the extension of the assembly as well as the rotation of rod 819-I so that the nestled pistons extend and retract in a manner similar to the zoom lens of camera. Of course, only one manner of operation of piston extension/retraction assembly 820 is described here. Potentially, other embodiments including, but not limited to, hydraulic or pneumatic mechanisms can likewise be adapted to the currently described configuration of the invention.

The manner in which extension/retraction assembly 820 retracts will now be explained. In order to retract the extended nestled pistons 820-P, a retraction cable 824-R is threaded through the hollow bore of threaded shaft 814-S. Retraction cable 824-R is fastened to the bottom of nestled pistons 820-P on a fixed axle 812-H which is disposed in the center of inner rod 819-I. Reversing the direction of rotation of spring loaded bobbin 815 begins the threading of retraction cable 824-R onto bobbin 815 which in effect pulls up nestled pistons 820-P. At the same time, this causes cogwheel 819-C to rotate in the opposite direction causing rod 819-I to do the same. The importance of this action will be made clear with regards to the description of FIG. 8B. One further important component is a rejection spring 822. The spring is coiled around retraction cable 824-R fixed on to nut assembly 814-N on the one end and fixed axle 812-H on the other. When assembly 820 extends, spring 822 is likewise extended such that the recoil force grows. When assembly 820 ceases to extend and no other pressure is holding the assembly in the extended position, then the recoil force of the spring causes, or at least aids, in the retraction of the assembly. Rejection spring 822 affords better controlled movement for 820-P. In one envisioned embodiment (not shown), spring 822 can be fixed to nut assembly 814-N on the one end and to rod 819-I on the other, so that when cog 819-C turns, then the torque of spring 822 is not increased (only compression force is increased). In a further envisioned embodiment an additional pulling arrangement (e.g. a retracting cable and an extending cable) and controlling bobbin (situated inside of the last nestled piston 820-P associated with rod 819-I and fixed axle 812-H) can be added to facilitate extending and collecting brush 804 and rail 802 (seen in FIG. 8B) once assembly 818 has reached the full extension—in order to clean the bottom surface of the toilet bowl. Of course, the aforementioned envisioned arrangement is merely exemplary and other similar arrangements that would be obvious to one skilled in the art are included in the scope of the invention.

Figure 8B:
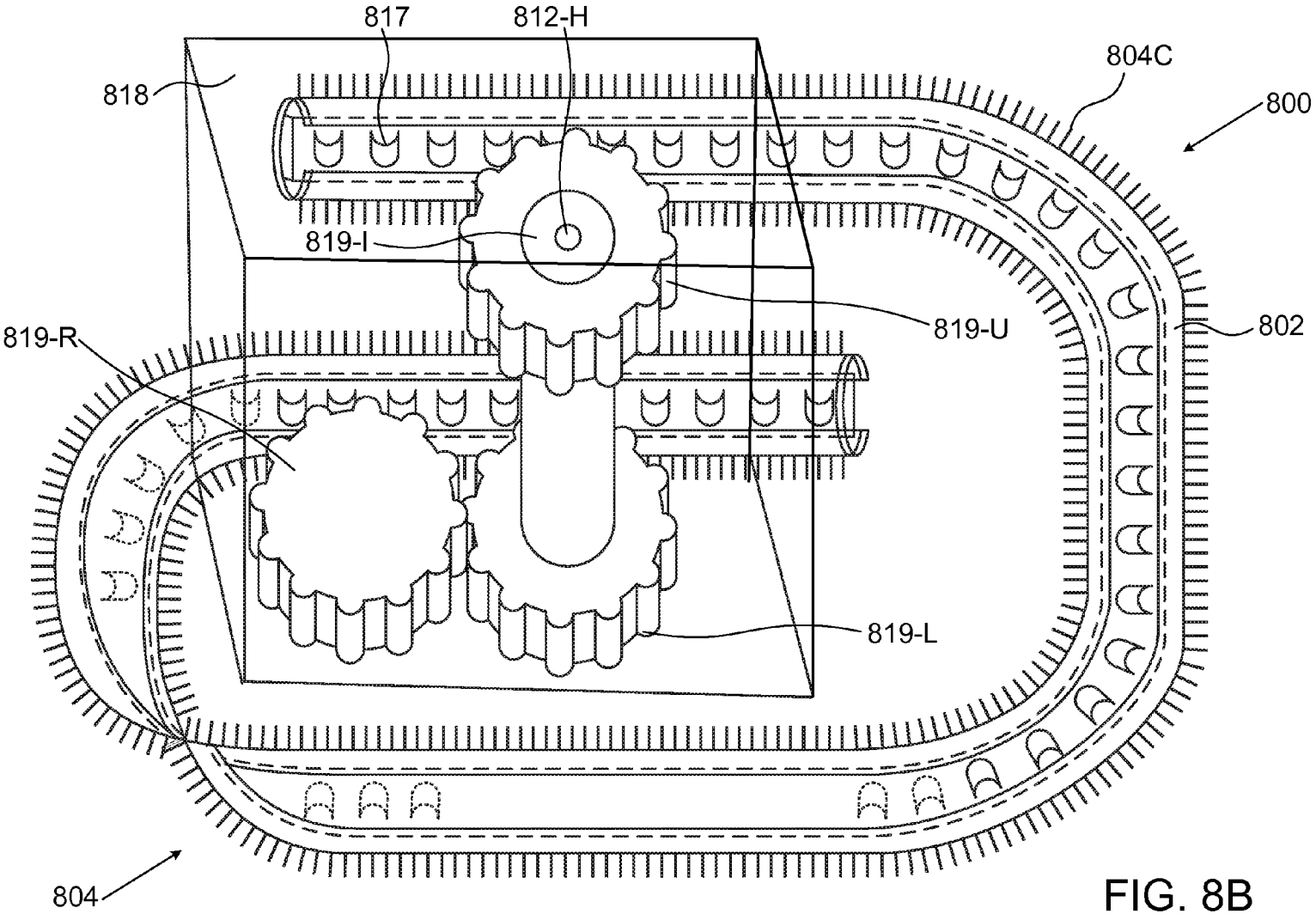
FIG. 8B is a schematic view of expansion/contraction assembly 818 and brush 804 arrangement.

FIG. 8B is a schematic view of expansion/contraction assembly/brush control mechanism 818 and brush 804 arrangement. Referring now to the Figure, rod 819-I extends into assembly 818 and is populated with an upper cogwheel 819-U and a lower cogwheel 819-L. (The current assembly differs from control mechanisms 700A-C in that there are no components similar to middle cogwheels 719A-C and cogs 716A-C.) A reversing cogwheel 819-R interlocks with the teeth of lower cogwheel 819-L. Brush 804 is a tube-brush 804 (as opposed to a coiled brush) having a tubular body, possibly of a plastic or rubber composition, with a tube rail 802 mounted thereon and populated with cleaning bristles 804C. Tube rail 802 includes teeth 817 which interlock with cogwheels 819-U and 819-L on an upper and lower ends respectively. Rotation of rod 819-I causes the contraction of tube-brush 804 by 'gathering in' a rail 802 which runs along one side of tube-brush 804. Tube-brush 804 incorporates a detergent carrying tube which in turn incorporates a plurality of non-drip holes. Bristles 804C populate the surface of the tube-brush, except for the area covered by rail 802. Tube-brush 804 may gather inside assembly 818 or behind the assembly, between the assembly and toilet bowl wall, or one side on the brush can gather inside assembly 818 while the other end 'gathers' behind the assembly. In the latter instances, the tube-brush 804 can also clean between the assembly and the toilet bowl wall. Various configurations of tube-brush 804 are envisioned, such as configurations similar to those discussed with regards to control mechanisms 700A-C.

Figure 9:
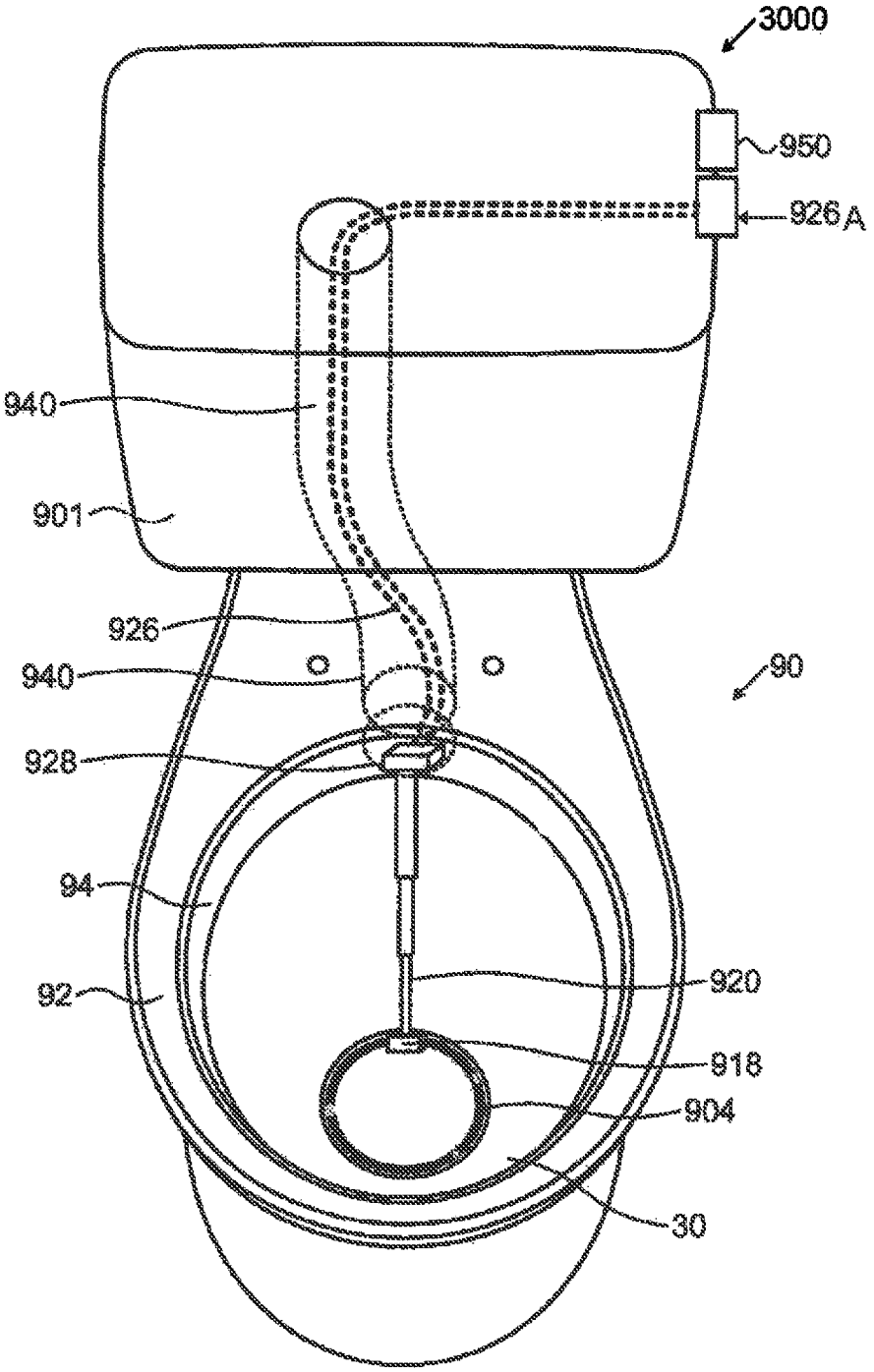
FIG. 9 is an overview of a third configuration of the inventive system (now referenced 3000).

FIG. 9 is an overview of a third configuration of an inventive system 3000. Referring now to the figure, there is provided a toilet 90 including a toilet bowl 30, a toilet rim 92, a water tank 901 and a water pipe 940 leading from the water tank to the toilet bowl. Disposed within water pipe 940 there is provided a platform 928 which sits at the mouth of pipe 940 (inside a toilet lip 94) and supports an extension/retraction assembly/movement actuation arrangement 920 which in turn supports an expansion/contraction assembly/brush control mechanism 918 which supports a brush 904 arrangement of the current invention.

Platform 928 must be installed in pipe 940 and is difficult to remove or replace. Therefore, expansion/contraction assembly 918 and/or brush 904 can be easily detached and replaced with prepackaged replacement components. Each of the aforementioned components is substantially similar to corresponding component in system 2000. A support 926 secures platform 928 to water tank 901 via water pipe 940. A control panel 926A included in support 926 controls the various functions of system 3000, and can be situated near a flushing lever 950 for convenience.

Hybrid embodiments of system 1000 and/or system 2000 and/or system 3000 are envisioned where redundant mechanisms serve to increase control and reliability of the overall hybrid system. Similarly, components mentioned in any of the various configurations of the various systems may be implemented interchangeably or in addition to one another. While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A toilet cleaning system, comprising:

(a) a brush adapted to clean an inner surface of a toilet bowl of a toilet;

(b) a brush control mechanism adapted to move said brush up and down, to clean said inner surface of said toilet bowl, said brush control mechanism including a dual-element construct, configured to convert between linear motion and rotational motion, wherein said dual element construct includes:

(A) a linear element; and (B) a rotational element, wherein said rotational element, is operationally coupled to said brush;

and whereby linear movement of said rotational element along said linear element causes said rotational element to rotate, thereby effecting rotational movement of said brush coupled thereto, thereby reversibly increasing said torque of said brush, causing said brush to rotate, contract and move linearly in the direction dictated by said rotational element;

(c) a support assembly adapted to operationally couple said brush control mechanism and said brush to said toilet; and (d) a movement actuation arrangement, operationally coupled on a first end to said support assembly and on a second end to said brush control mechanism, wherein said movement actuation arrangement is configured to effect a reversible downward movement of said brush control mechanism towards a floor of said toilet bowl, wherein said brush control mechanism further includes:

(i) a slideable element coupled to said dual-element construct; and (ii) a guide shaft, housing said slideable element, wherein said slideable element is configured to move within said guide shaft during said linear movement of said rotational element, said rotational element being operationally coupled to said slideable element.

2. The toilet cleaning system of claim 1, wherein said brush control mechanism further includes:

(iii) a pad having said linear element of said dual element construct mounted thereon and further having said guide shaft mounted thereon.

3. The toilet cleaning system of claim 2, wherein said pad is adapted to convolve about an axle positioned below said toilet lip.

4. The toilet cleaning system of claim 2, wherein said pad is comprised of elastic plastic material allowing said pad to convolve and unfurl.

5. The toilet cleaning system of claim 1, wherein said brush control mechanism further includes:

(iii) a rod, operationally coupled to a first end of said brush and further operationally coupled to said rotational element.

6. The toilet cleaning system of claim 5, wherein said rod includes:

(A) an axle portion, fixedly disposed in said slideable element, and (B) a termination portion, fixedly disposed in said rotational element.

7. The toilet cleaning system of claim 6, wherein a flexible metallic core is threaded through a hole in said termination portion of said rod within said rotational element and attached to a point on an internal edge of said rotational element, said edge being adjacent to said slideable element, so that during said rotation of said rotational element, said flexible metallic core is reversibly drawn out of a protective cover and reversibly wound around said rod.

8. The toilet cleaning system of claim 1, wherein said brush control mechanism further includes:

(iii) a cog assembly, disposed in said slideable element;

(iv) a brush-rail, associated with said brush; and (v) rail teeth, mounted on said brush rail, wherein said cog assembly is adapted to be in interlocking mechanical communication said rail teeth of said brush rail.

9. The toilet cleaning system of claim 8, wherein said brush is wound around said brush rail.

10. A toilet cleaning system comprising:

(a) a brush adapted to clean an inner surface of a toilet bowl of a toilet;

(b) a brush control mechanism adapted to move said brush up and down, to clean said inner surface of said toilet bowl, said brush control mechanism including a dual-element construct, configured to convert between linear motion and rotational motion;

(c) a support assembly adapted to operationally couple said brush control mechanism and said brush to said toilet; and (d) a movement actuation arrangement, operationally coupled on a first end to said support assembly and on a second end to said brush control mechanism, wherein said movement actuation arrangement is configured to effect a reversible downward movement of said brush control mechanism towards a floor of said toilet bowl, wherein said movement actuation arrangement includes a ball screw assembly effecting said reversible downward movement of said brush control mechanism towards said floor of said toilet bowl.

11. The toilet cleaning system of claim 10, wherein said brush is a tube brush including:

(i) a tubular body;

(ii) a tube rail, mounted on said tubular body;

(iii) rail teeth, mounted on said tube rail; and (iv) bristles populating said tubular body.

12. The toilet cleaning system of claim 11, wherein said tube brush further includes:

(v) an accordion pleat section of said tubular body, said accordion pleat section adapted to electively expand and contract.

13. The toilet cleaning system of claim 11, wherein said brush control mechanism includes:

(i) a cog assembly including:

(A) an upper cog, configured to interlock with said rail teeth mounted on a first end of said tube rail;

(B) a lower cog, configured to interlock with said rail teeth mounted on a second end of said tube-rail;

(C) an inner rod, forming a common axle for said upper cog and said lower cog, said inner rod operationally coupled to a threaded shaft such that rotation of said inner rod effects rotation of said upper and lower cogs, effecting a gathering movement of said tube rail; and (D) a reverse cog, configured to interlock with said lower cog and said rail teeth mounted on said second end of said tube rail, interposing between said lower cog and said rail teeth, such that said reverse cog, when rotated, effects said gathering movement of said second end of said tube rail, when said rail teeth mounted on said second end and said rail teeth mounted on said first end both face a common direction.

14. A toilet cleaning system, comprising:

(a) a brush adapted to clean an inner surface of a toilet bowl of a toilet;

(b) a brush control mechanism adapted to move said brush up and down, to clean said inner surface of said toilet bowl, said brush control mechanism including a dual-element construct, configured to convert between linear motion and rotational motion;

(c) a support assembly adapted to operationally couple said brush control mechanism and said brush to said toilet; and (d) a movement actuation arrangement, operationally coupled on a first end to said support assembly and on a second end to said brush control mechanism, wherein said movement actuation arrangement is configured to effect a reversible downward movement of said brush control mechanism towards a floor of said toilet bowl, wherein the toilet cleaning system is disposed within a water pipe connecting a water tank of said toilet to said toilet bowl of said toilet, such that said movement actuation arrangement is located within said toilet bowl, and wherein said movement actuation arrangement includes a plurality of nestled pistons.

15. The toilet cleaning system of claim 14, wherein said plurality of nestled pistons is reversibly telescopically extended by a means selected from the group including: a hydraulic means and a pneumatic means.

16. The toilet cleaning system of claim 14, further comprising (e) a fluid tube operationally coupled to said brush, said fluid tube configured to electively hold and release fluid.

17. The toilet cleaning system of claim 16, further comprising:

(f) a detergent reservoir, said reservoir configured to receive a fluid, wherein said detergent reservoir is operationally coupled to said fluid tube, configured to supply said fluid tube with said fluid.

18. The toilet cleaning system of claim 17, wherein said detergent reservoir is configured to receive a prepackaged detergent.

* * * * *